US011644288B2

(12) United States Patent
Schuh et al.

(10) Patent No.: US 11,644,288 B2
(45) Date of Patent: May 9, 2023

(54) NANOCRYSTALLINE ALLOY PENETRATORS

(71) Applicant: Massachusetts Institute of Technology, Cambridge, MA (US)

(72) Inventors: Christopher A. Schuh, Wayland, MA (US); Zachary Copoulos Cordero, Cambridge, MA (US); Mansoo Park, Boston, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 15/268,096

(22) Filed: Sep. 16, 2016

(65) Prior Publication Data

US 2017/0234663 A1 Aug. 17, 2017

Related U.S. Application Data

(60) Provisional application No. 62/220,109, filed on Sep. 17, 2015.

(51) Int. Cl.

| | |
|---|---|
| ***F42B 12/74*** | (2006.01) |
| ***F42B 12/06*** | (2006.01) |
| ***C22C 27/04*** | (2006.01) |
| ***C22C 27/06*** | (2006.01) |
| ***C22F 1/18*** | (2006.01) |

(52) U.S. Cl.

CPC ..... *F42B 12/06* (2013.01); *C22C 27/04* (2013.01); *C22C 27/06* (2013.01); *C22F 1/18* (2013.01); *F42B 12/74* (2013.01)

(58) Field of Classification Search

CPC ..... F42B 12/74; F42B 30/02

See application file for complete search history.

(56) References Cited

U.S. PATENT DOCUMENTS

| | | | |
|---|---|---|---|
| 3,479,161 | A | 11/1969 | Evans |
| 3,904,383 | A | 9/1975 | Murphy et al. |
| 4,822,415 | A | 4/1989 | Dorfman et al. |
| 4,867,806 | A | 9/1989 | Shiina |
| 4,909,840 | A | 3/1990 | Schlump |
| 4,944,800 | A | 7/1990 | Kolaska et al. |

(Continued)

FOREIGN PATENT DOCUMENTS

| | | | |
|---|---|---|---|
| CN | 86107901 | A | 5/1987 |
| CN | 1070431 | A | 3/1993 |

(Continued)

OTHER PUBLICATIONS

Leferink et al., Chromium Diffusion Coatings on Low-Alloyed Steels for Corrosion Protection Under Sulphidizing Conditions. VGB Kraftwerkstechnik. 1993. 73(3): 1-14.

(Continued)

*Primary Examiner* — J. Woodrow Eldred

(74) *Attorney, Agent, or Firm* — Wolf, Greenfield & Sacks, P.C.

(57) ABSTRACT

Nanocrystalline alloy penetrators and related methods are generally provided. In some embodiments, a munition comprises a nanocrystalline alloy penetrator. In certain embodiments, the nanocrystalline alloy has particular properties (e.g., grain size, grain isotropy, mechanical properties) such that the penetrator acts as a rigid body kinetic penetrator.

31 Claims, 14 Drawing Sheets

(56) References Cited

U.S. PATENT DOCUMENTS

| | | | | |
|---|---|---|---|---|
| 5,024,813 | A | 6/1991 | Nishiyama | |
| 5,207,821 | A | 5/1993 | Ikenoue et al. | |
| 5,395,422 | A | 3/1995 | Schulz et al. | |
| 5,425,822 | A | 6/1995 | Hidaka et al. | |
| 5,590,387 | A | 12/1996 | Schmidt et al. | |
| 5,897,962 | A | 4/1999 | Houck et al. | |
| 5,984,996 | A | 11/1999 | Gonsalves et al. | |
| 5,989,491 | A | 11/1999 | Isomoto et al. | |
| 6,010,580 | A | 1/2000 | Dandliker et al. | |
| 6,171,410 | B1 | 1/2001 | Kojima et al. | |
| 6,277,326 | B1 | 8/2001 | Vecchio et al. | |
| 6,489,043 | B1 | 12/2002 | Deevi et al. | |
| 7,004,853 | B2 | 2/2006 | Deshmukh | |
| 7,416,697 | B2 | 8/2008 | Woodfield et al. | |
| 7,708,974 | B2 | 5/2010 | Yadav | |
| 7,955,448 | B2 | 6/2011 | Terao et al. | |
| 8,174,851 | B2 * | 5/2012 | Elferich | H02M 3/3376 363/21.02 |
| 8,257,512 | B1 | 9/2012 | Branagan et al. | |
| 8,287,665 | B2 | 10/2012 | Urata et al. | |
| 8,414,712 | B2 | 4/2013 | Yoshizawa et al. | |
| 10,407,757 | B2 | 9/2019 | Schuh et al. | |
| 2002/0088508 | A1 | 7/2002 | Holzl et al. | |
| 2003/0101891 | A1 * | 6/2003 | Amick | F42B 12/34 102/514 |
| 2003/0183306 | A1 | 10/2003 | Hehmann et al. | |
| 2004/0045402 | A1 | 3/2004 | Boily et al. | |
| 2004/0253136 | A1 | 12/2004 | Shamblen et al. | |
| 2005/0084407 | A1 | 4/2005 | Myrick | |
| 2006/0121332 | A1 | 6/2006 | He et al. | |
| 2006/0127266 | A1 | 6/2006 | Miura et al. | |
| 2006/0153728 | A1 | 7/2006 | Schoenung et al. | |
| 2007/0293348 | A1 | 12/2007 | Hocknell et al. | |
| 2008/0223175 | A1 * | 9/2008 | Lunk | B22F 9/22 75/369 |
| 2009/0068055 | A1 | 3/2009 | Sreedhara et al. | |
| 2010/0097171 | A1 | 4/2010 | Urata et al. | |
| 2010/0189910 | A1 | 7/2010 | Belashchenko | |
| 2010/0230010 | A1 | 9/2010 | Yoshizawa et al. | |
| 2010/0251921 | A1 * | 10/2010 | Siddle | C22C 32/0052 102/501 |
| 2011/0265757 | A1 | 11/2011 | Bishop et al. | |
| 2012/0021221 | A1 | 1/2012 | Miyoshi | |
| 2012/0207640 | A1 | 8/2012 | Harrigan, Jr. | |
| 2013/0248754 | A1 | 9/2013 | Sakuma et al. | |
| 2014/0271325 | A1 | 9/2014 | Schuh et al. | |
| 2014/0348203 | A1 | 11/2014 | Murdoch et al. | |
| 2015/0147225 | A1 | 5/2015 | Lee et al. | |
| 2016/0155566 | A1 | 6/2016 | Yoon et al. | |
| 2016/0223307 | A1 * | 8/2016 | Bray | F42B 30/02 |
| 2017/0067136 | A1 | 3/2017 | Hussein et al. | |
| 2017/0080498 | A1 | 3/2017 | Burrow | |
| 2017/0252807 | A1 | 9/2017 | Lund et al. | |
| 2017/0297112 | A9 * | 10/2017 | Burrow | B22F 5/00 |
| 2018/0169759 | A1 | 6/2018 | Nakamura et al. | |
| 2018/0363106 | A1 | 12/2018 | Amram et al. | |
| 2019/0300986 | A1 | 10/2019 | Graetz et al. | |
| 2020/0010937 | A1 | 1/2020 | Schuh et al. | |

FOREIGN PATENT DOCUMENTS

| | | | |
|---|---|---|---|
| CN | 1498287 | A | 5/2004 |
| CN | 1685071 | A | 10/2005 |
| CN | 101081434 | A | 12/2007 |
| CN | 101223108 | A | 7/2008 |
| CN | 101343708 | A | 1/2009 |
| CN | 101423912 | A | 5/2009 |
| CN | 101636515 | A | 1/2010 |
| CN | 101796207 | A | 8/2010 |
| CN | 102071346 | A | 5/2011 |
| CN | 103028149 | A | 4/2013 |
| CN | 103422002 | A | 12/2013 |
| CN | 103028148 | B | 8/2014 |
| CN | 104313391 | A | 1/2015 |
| CN | 104419846 | A | 3/2015 |
| CN | 104911380 | A | 9/2015 |
| CN | 105063394 | A | 11/2015 |
| CN | 102888530 | B | 12/2015 |
| CN | 105112832 | A | 12/2015 |
| CN | 105238954 | A | 1/2016 |
| CN | 105603230 | A | 5/2016 |
| EP | 2927333 | A1 | 10/2015 |
| EP | 3510177 | A2 | 7/2019 |
| JP | S62-44526 | A | 2/1987 |
| JP | H02-129329 | A | 5/1990 |
| JP | 05-222481 | A | 8/1993 |
| JP | H06-212202 | A | 8/1994 |
| JP | 09-157048 | A | 6/1997 |
| JP | H10-152701 | A | 6/1998 |
| JP | 2004-131822 | A | 4/2004 |
| JP | 2006-052430 | A | 2/2006 |
| JP | 2007-515551 | A | 6/2007 |
| JP | 2010-209417 | A | 9/2010 |
| JP | 4923498 | B2 | 4/2012 |
| JP | 2012-192016 | A | 10/2012 |
| JP | 2013-185162 | A | 9/2013 |
| JP | 2014-517875 | A | 7/2014 |
| JP | 2014-216074 | A | 11/2014 |
| JP | 2016-194095 | A | 11/2016 |
| KR | 100570551 | B1 | 4/2006 |
| KR | 100784992 | B1 | 12/2007 |
| KR | 20110055891 | A | 5/2011 |
| KR | 20120086457 | A | 8/2012 |
| KR | 10-2013-0134014 | A | 12/2013 |
| SU | 555162 | A1 | 5/1977 |
| WO | WO 2005/051579 | A2 | 6/2005 |
| WO | WO 2007/086830 | A2 | 8/2007 |
| WO | WO 2011/091449 | A1 | 7/2011 |
| WO | WO 2012/162074 | A1 | 11/2012 |
| WO | WO 2013/137857 | A2 | 9/2013 |
| WO | WO 2014/152838 | A1 | 9/2014 |
| WO | WO 2014/189924 | A2 | 11/2014 |
| WO | WO 2018/125314 | A2 | 7/2018 |

OTHER PUBLICATIONS

International Search Report and Written Opinion dated Jul. 19, 2017 for Application No. PCT/US2016/052152.

Amato, On the mechanism of activated sintering of tungsten powders. Materials Science and Engineering. 1972. 10: 15-22.

Ames et al., Unraveling the nature of room temperature grain growth in nanocrystalline materials. Acta Materialia. Sep. 2008. 56(16): 4255-4266. doi:10.1016/j.actamat.2008.04.051.

Beth, Concrete Penetration. Division 2, National Defense Research Committee of the Office of Scientific Research and Development. Wright-Patterson Air Force Base-Dayton, Ohio. 1946. 65 pages.

Bose et al., Microstructural Refinement of W—Ni—Fe Heavy Alloys by Alloying Additions. Metallurgical Transactions A. Dec. 1988. 19A (12): 3100-3103. doi: 10.1007/BF02647738.

Bui et al., On the strengthening behavior of ultrafine-grained nickel processed from nanopowders. Materials Science and Engineering A. 2010. 527: 3227-3235.

Chen et al., Sintering dense nanocrystalline ceramics without final-stage grain growth. Nature. Mar. 9, 2000. 404(6774):168-71.

Cho et al., Nanocrystalline and Ultra-Fine Grained Tungsten for Kinetic Energy Penetrator and Warhead Liner Applications. Army Research Laboratory. ARL-RP-180. Jun. 2007. 14 pages.

Chookajorn et al., Design of stable nanocrystalline alloys. Science. Aug. 23, 2012;337(6097):951-4. doi: 10.1126/science.1224737.

Cordero et al., Sub-scale ballistic testing of an ultrafine grained tungsten alloy into concrete targets. Int J Impact Eng. 2016;91:1-5. Epub Dec. 18, 2015.

Cordero et al., Powder-Route Synthesis and Mechanical Testing of Ultrafine Grain Tungsten Alloys. Metallurgical and Materials Transactions A. Jul. 2014. 45A: 3609-3618. doi: 10.1007/s11661-014-2286-1.

Da Costa, Sinter densification of nanocrystalline composite W—Cu powder. International Journal of Powder Metallurgy. Jul. 31, 2005; 41(4): 51-57.

(56) References Cited

OTHER PUBLICATIONS

Ehlers et al. Small-Caliber Projectile Target Impact Angle Determined from Close Proximity Radiographs. Army Research Laboratory. DTIC Document. ARL-TR-3943. Oct. 2006. 51 pages.
Forrestal et al., A spherical cavity-expansion penetration model for concrete targets. International Journal of Solids and Structures. Nov. 1997. 34(31-32): 4127-46. doi:10.1016/S0020-7683(97)00017-6.
Forrestal et al., An empirical equation for penetration depth of ogive-nose projectiles into concrete targets. International Journal of Impact Engineering. Aug. 1994. 15(4): 395-405. doi:10.1016/0734-743X(94)80024-4.
Forrestal et al., Dynamic Spherical Cavity-Expansion in a Compressible Elastic-Plastic Solid. J. Appl Mech. Jun. 1, 1988. 55(2): 275-9. doi:10.1115/1.3173672.
Forrestal et al., Penetration into soil targets. International Journal of Impact Engineering. 1992. 12(3): 427-44. doi:10.1016/0734-743X(92)90167-R.
Forrestal et al., Penetration of 6061-T651 Aluminum Targets With Rigid Long Rods. J Appl Mech. Dec. 1, 1988. 55(4): 755-60. doi:10.1115/1.3173718.
Forrestal et al., Penetration of concrete targets with deceleration-time measurements. International Journal of Impact Engineering. May 2003. 28(5): 479-97.
Forrestal et al., Penetration of grout and concrete targets with ogive-nose steel projectiles. International Journal of Impact Engineering. Jul. 1996. 18(5): 465-76. doi:10.1016/0734-743X(95)00048-F.
Forrestal et al., Penetration of reinforced concrete with ogive-nose penetrators. International Journal of Solids and Structures. 1988. 24(1):77-87.
Forrestal, Penetration into dry porous rock. International Journal of Solids and Structures. 1986. 22(12): 1485-1500. doi:10.1016/0020-7683(86)90057-0.
Frew et al., Penetration of concrete targets with ogive-nose steel rods. International Journal of Impact Engineering. Jun. 1, 1998. 21(6): 489-97. doi:10.1016/50734-743X(98)00008-6.
Frew et al., The effect of concrete target diameter on projectile deceleration and penetration depth. International Journal of Impact Engineering. Oct. 2006. 32(10): 1584-1594. doi:10.1016/j.ijimpeng.2005.01.012.
Gente et al., Formation of Thermodynamically Unstable Solid Solutions in the Cu—Co System by Mechanical Alloying. Physical Review B. Nov. 1993;48(18): 13244-52.
German et al, Enhanced Low-Temperature Sintering of Tungsten. Metallurgical Transactions A. Dec. 1976. 7A(12):1873-7. DOI: 10.1007/BF02659818.
German et al. The Effect of Nickel and Palladium Additions on Activated Sintering of Tungsten. Int J Powder Metall. Apr. 12, 1976(2): 115-125.
German et al., Systematic Trends in Chemically Activated Sintering of Tungsten. High Temp Sci. 1976. 8:267-80.
German, Liquid phase sintering. Plenum Press, New York. 1985-TOC. 4 pages.
German, Microstructure of the Gravitationally Settled Region in a Liquid-Phase Sintered Dilute Tungsten Heavy Alloy. Metallurgical and Materials Transactions A. Feb. 1995.26A: 279-88.
Gleiter, Nanocrystalline Materials. Progress in Materials Science. 1989. 33: 223-315.
Gupta et al., Thin intergranular films and solid-state activated sintering in nickel-doped tungsten. Acta Materialia. 2007;55:3131-42.
Hague et al., Modeling densification during sinter-forging of yttria-partially-stabilized zirconia. Materials Science and Engineering. 1995;A204:83-9.
Hausner. Metal Powder Industries Federation. Modern Developments in Powder Metallurgy proceedings. Proceedings of the 1965 International Powder Metallurgy Conference. vol. 1. Fundamentals and Methods. 1966. Plenum Press, New York. 6 pages.
Huskins et al., Micropillar compression testing of powders. J Mater Sci. 2015;50(21):7058-63.
Johnson et al., Solid-state contributions to densification during liquid phase sintering. Metallurgical and Materials Translations B. Dec. 1996. 27B: 901-9.
Kang et al., Densification and Shrinkage during Liquid-Phase Sintering. Journal American Ceramic Society. 1991. 74(2): 425-7.
Kecskes et al., Grain size engineering of bcc refractory metals: Top-down and bottom-up-Application to tungsten. Mater Sci Eng A. Oct. 15, 2007. 467(1-2): 33-43. doi:10.1016/j.msea.2007.02.099.
Kircheim et al., Grain coarsening inhibited by solute segregation. Acta Materialia. 2002. 50: 413-9.
Kleinlogel et al., Sintering of nanocrystalline $CeO_2$ Ceramics. Advanced Materials. 2001. 13 (14): 1081-5.
Knowles, Dielectric Constant of Ethyl Alcohol Vapor and Possible Effect of Conductivity. The Journal of Physical Chemistry. 1931. 36(10): 2554-66. doi: 10.1021/j150340a003.
Kothari et al., Densification and Grain Growth during Liquid-Phase Sintering of Tungsten-Nickel-Copper Alloys. Journal of the Less-Common Metals. 1967. 13: 457-68.
Kuczynski et al., Segregation in Homogeneous Alloys during Sinstering. Acta Metallurgica. Mar. 8, 1960: 209-15.
Kumar et al., Densification of Nanostructured Titania Assisted by a Phase-Transformation. Nature. Jul. 2, 1992. 358: 48-51.
Lee et al., Microstructural Evolution and Mechanical Properties under High Strain Rate Testing of W-3.99Ni-1.71Fe Sintered by a Two-Stage Sintering Process. Materials Transactions. 2012. 53(7): 1318-23.
Lee et al., Theoretical analysis of liquid-phase sintering: Pore filling theory. Acta Mater. 1998. 46(9): 3191-3202.
Li et al., The Properties of Tungsten Processed by Chemically Activated Sintering. Metallurgical Transactions A. Oct. 1983. 14A: 2031-41.
Lian et al., On the Enhanced Grain-Growth in Ultrafine Grained Metals. Acta Metall Mater. 1995;43(11): 4165-70.
Liao et al., Theory of high pressure/low temperature sintering of bulk nanocrystalline. $TiO_2$. Acta Mater. 1997. 45(10): 4027-40.
Luk et al., Penetration into semi-infinite reinforced-concrete targets with spherical and ogival nose projectiles. Intl Impact Engng. 1987. 6(4): 291-301. doi:10.1016/0734-743X(87)90096-0.
Luo et al. The Role of a Bilayer Interfacial Phase on Liquid Metal Embrittlement. Science. Sep. 2011;333:1730-3.
Luo et al., Grain boundary disordering in binary alloys. Applied Physics Letters. Mar. 2008;92: 101901-1 to 101901-3.
Luo et al., Segregation-induced grain boundary premelting in nickel-doped tungsten. Applied Physics Letters. 2005. 87: 231902-1 to 231902-3.
Mishra et al., High-pressure sintering of nanocrystallinie $_y$-$AI_2O_3$. J. Am. Ceram Soc. 1996. 79(11): 2989-2992.
Monma et al., Diffusion of Ni63 and Cr51 in nickelchromium alloys. Eng. Abs. Nihon Kinzoku Gakkai. 1964. 25: 188-192.
Mundy et al., Self-Diffusion in Chromium. Physical Review B. Jul. 15, 1981. 24 (2): 658-65.
Mundy et al., Self-Diffusion in Tungsten. Physical Review B. Dec. 15, 1978. 18 (12): 6566-75.
Murdoch et al., Stability of binary nanocrystalline alloys against grain growth and phase separation. Acta Materialia. 2013. 61: 2121-32.
Orru et al., Consolidation/synthesis of materials by electric current activated/assisted sintering. Materials Science and Engineering R. 2009. 63: 127-287. Submitted in 2 parts.
Paiste, Deforming and compacting chromium-tungsten powders to create stronger metals. MIT News, Phys Org. Dec. 3, 2014. Retrieved Aug. 10, 2015 from http://phys.org/news/2014-12-deforming-compacting-chromium-tungsten-powders-stronger.html. 4 pages.
Paiste, Alloying tougher tungsten. MIT MPC Webpage. Updated Dec. 1, 2014. https://mpc-www.mit/edu/component/k2/item/469-alloying-tougher-tungsten, accessed on the internet Aug. 10, 2015. 5 pages.
Paiste, Tougher tungsten to replace uranium in armor-piercing projectiles. PDD Webpage. Dec. 4, 2014. https://www.pddnet.com/news/2014/12/tougher-tungsten-replace-uranium-armor-piercing-projectiles, accessed on the internet Aug. 10, 2015. 11 pages.

(56) References Cited

OTHER PUBLICATIONS

Park et al., Accelerated sintering in phase-separating nanostructured alloys. Nature Communications. Apr. 2015;6:6858(1-6). doi: 10.1038/ncomms7858.
Park et al., Diffusion of tungsten in chromium: Experiments and atomistic modeling. J Alloy Compd. Available online May 27, 2014. 611: 433-9. doi:10.1016/j.jallcom.2014.05.085.
Park et al., Grain Growth behavior of tungsten heavy alloys based on the master sintering curve concept. Metallurgical Transactions A. Nov. 2006. 37A: 3337-46.
Park et al., Microstructural Change during Liquid-Phase Sintering of W—Ni—Fe Alloy. Metallurgical Transactions A. May 1989. 20A: 837-45.
Schuh et al., Powder processing of amorphous tungsten-bearing alloys and composites. Defense Threat Reduction Agency, DTRA-TR-14-73, Technical Report. Mar. 2015. HDTRA1-11-1-0062. 25 pages.
Schuster et al., Nanocrystalline refractory metals for extreme condition applications. JOM. Dec. 2011;63(12):27-31.
Silling et al., Mass loss from abrasion on ogive-nose steel projectiles that penetrate concrete targets. International Journal of Impact Engineering. Nov. 2007. 34(11): 1814-20. doi:10.1016/j.ijimpeng.2006.10.008.
Srinivasarao et al., Bimodally grained high-strength Fe fabricated by mechanical alloying and spark plasma sintering. Acta Materialia. 2009. 57: 3277-86.
Su et al., Master sintering curve: a practical approach to sintering. Journal of American Ceramic Society. 1996. 79(12): 3211-17.
Telu et al. Densification and characterisation of W—Cr—Nb alloys prepared by sintering of mechanically alloyed nanocrystalline powders. Powder Metallurgy. Feb. 28, 2013; 56(1): 83-88.
Turchi et al., Modeling of Ni—Cr—Mo based alloys: Part 1-phase stability. Computer Coupling of Phase Diagrams and Thermochemistry. 2006. 30: 70-87.
Uenishi et al., Formation of a Super-Saturated Solid-Solution in the Ag—Cu System by Mechanical Alloying. Materials Science and Engineering A. 1991. A134: 1342-5.
Vacek et al., Uber die Beeinflussung des Sinterverhaltens von Wolfram. Methods of Influencing the Sintering Behavior of Tungsten. Eng. Abs. Planseeber. Pulvermet. 1959. bd 7, 6. 5 pages.
Warren et al., Evaluation of Large Amplitude Deceleration Data from Projectile Penetration into Concrete Targets. Experimental Mechanics. Feb. 2014. 54(2):241-53. E Pub Jul. 17, 2013. DOI: 10.1007/s11340-013-9767-9.
Wei et al., Dynamic behaviors of body-centered cubic metals with ultrafine grained and nanocrystalline microstructures. Mater Sci Eng A. Oct. 15, 2008. 493(1-2): 58-64. doi:10.1016/j.msea.2007.05.126.
Wei et al., Effect of low-temperature rolling on the tensile behavior of commercially pure tungsten. Mater Sci Eng A. Sep. 15, 2008. 491 (1-2): 62-9. doi:10.1016/j.msea.2008.01.013.
Wei et al., Microstructure and mechanical properties at different length scales and strain rates of nanocrystalline tantalum produced by high-pressure torsion. Acta Materialia. Apr. 2011. 59(6): 2423-36. doi:10.1016/j.actamat.2010.12.042.
Wei et al., Microstructure and mechanical properties of super-strong nanocrystalline tungsten processed by high-pressure torsion. Acta Materialia. Sep. 2006. 54 (15): 4079-89.
Wei et al., Nanoengineering opens a new era for tungsten as well. The Journal of the Minerals, Metals & Materials Society (TMS). Sep. 2006. 58(9):40-4. DOI10.1007/s11837-006-0081-1.
Weissmuller. Alloy Effects in Nanostructures. Nanostructured Materials. 1993. 3: 261-72.
Yan et al., Fabrication of nano-crystalline W—Ni—Fe pre-alloyed powders by mechanical alloying technique. Trans. Nonferrous Met Soc China. Dec. 1, 2009; 19:s711-s717.
Yavari et al., Mechanically Driven Alloying of Immiscible Elements. Physical Review Letters. 1992. 68(14): 2235-8. 6 pages.
Yih, Tungsten: sources, metallurgy, properties, and applications. (Plenum Press, New York, 1979). 6 pages.
Yoon et al., Grain-Growth and Densification during Liquid-Phase Sintering of W—Ni. Acta Metallurgica. 1979. 27: 693-8.
Zhan et al., Single-wall carbon nanotubes as attractive toughening agents in alumina-based nanocomposites. Nature Materials. Jan. 2003; 2: 38-42.
Zhang et al. Fabrication of bulk noncrystalline Fe—C alloy by spark plasma sintering of mechanically milled powder. Scripta Materialia. 2005. 53: 863-8.
Zhang et al. Microstructure characteristic, mechanical properties and sintering mechanism of nanocrystalline copper obtained by SPS process. Materials Science and Engineering A. 2009. 523: 134-8.
Han et al., The effects of ball-milling treatment on the densification behavior of ultra-fine tungsten powder. Int J Refract Metals and Hard Mater. 2011;29:743-50. doi: 10.1016/j.ijrmhm.2011.06.010.
Kornilov, Solubility of the elements in chromium. Bull Acad Sci of the USSR, Div Chem Sci. Nov. 1953;2(6):871-7. https://doi.org/10.1007/BF01167529.
[No Author Listed], Sinter and Hot Pressing Definitions from ISO 3252. 2103-hot pressing; 3105 pressure sintering; 30001 sintering. Powder Metallurgy Vocabulary (Year: 1999). 1999. https://www.iso.org/obp/ui/#iso:3252:ed-4:v1:en:term:3015. 3 pages.
Amram et al., Interplay between thermodynamic and kinetic stabilization mechanisms in nanocrystalline Fe—Mg alloys. Acta Mater. 2018;144:447-58. Epub Nov. 7, 2017.
Cayless et al., Alloy and temper designation systems for aluminum and aluminum alloys. ASM Handbook, vol. 2: Properties and Selection: Nonferrous alloys and Special-Purpose materials. ASM Handbook Committee, 1990;15-28.
Chookajorn et al., Duplex nanocrystalline alloys: Entropic nanostructure stabilization and a case study on W—Cr. J Mater Res. Jan. 28, 2015;30(2):151-63.
Clark et al., Thermal stability comparison of nanocrystalline Fe-based binary alloy pairs. JOM. Jun. 2016;68(6):1625-33. Epub Mar. 24, 2016.
Darling et al., Mitigating grain growth in binary nanocrystalline alloys through solute selection based on thermodynamic stability maps. Comput Mater Sci. Mar. 2014; 84:255-66. Epub Dec. 31, 2013.
Darling et al., Extreme creep resistance in a microstructurally stable nanocrystalline alloy. Nature. Sep. 15, 2016;537:378-81. Suppl Info 10 pages. doi: 10/1038/nature19313.
Huang et al., Exploring the concurrence of phase transition and grain growth in nanostructured alloy. Acta Mater. Oct. 1, 2016;118:306-16. Epub Aug. 5, 2016.
Kalidindi et al., Nanocrystalline materials at equilibrium: A thermodynamic review. JOM. Dec. 2015;67(12):2834-43. Epub Sep. 23, 2015.
Khalajhedayati et al., High-temperature stability and grain boundary complexion formation in a nanocrystalline Cu—Zr alloy. JOM. Dec. 2015;67(12):2788-801. Epub Sep. 23, 2015.
Moelle et al., Thermal stability of nanocrystalline iron prepared by mechanical attrition. NanoStructured Mater. 1995;6:421-424.
Murray, Mg—Ti. Binary Alloy Phase Diagrams, II. Edition. 1990;3:2559-60.
Natter et al., Nanocrystalline nickel and nickel-copper alloys: Synthesis, characterization, and thermal stability. J Mater Res. May 1998;13(5):1186-97.
Nieman et al., Tensile strength and creep properties of nanocrystalline palladium. Scripta Metall et Mater. Jan. 1990;24(1):145-50.
Oda et al., Microstructure and sinterability of nano-crystal tungsten powders. J Japan Inst Metals and Mater. 2005;69(11):967-72. doi:10/2320/jinstmet.69.697.
Ogawa, Mechanical properties of hot compacting high nitrogen nanocrystalline austenite stainless steel powders mechanically alloyed, Discussion 52, Collection of papers of lectures by the Iron and Steel Inst of Japan, Materials and Processes, Japan, Mar. 1, 1999;12(1):CAMP-ISIJ, ISSN:0914-6628.
Panichkina, Activated sintering of tungsten with small additions of nickel. Theory and Technology of Sintering, Thermal, and Chemicothermal Treatment Processes. Institute of Materials Science, Academy of Sciences of the UkrSSR. 1967;87-90. Translated from Poroshkovaya Metallurgiya, Feb. 1967;No. 2(50):1-5.

(56) References Cited

OTHER PUBLICATIONS

Park, Design of Bulk Nanocrystalline Tungsten Alloys via Nano-Phase Separation Sintering. PhD Thesis, Massachusetts Institute of Technology. Department of Materials Science and Engineering. Submitted Feb. 2015. Believed to have been published Aug. 2015. 112 pages. Submitted in 2 parts.
Robertson et al., Review of densification of titanium based powder systems in press and sinter processing. Powder Metall. 2010;53(2):146-62.
Xu et al., Microstructures and stabilization mechanisms of nanocrystalline iron-chromium alloys with hafnium addition. Metall Mater Trans A. Sep. 2015;46A:4394-404. Epub Jun. 2, 2015.
Crosby et al., Enhancement in Ti—6Al—4V sintering via nanostructured powder and spark plasma sintering. Powder Metallurgy. Jan. 15, 2014;57(2):147-54. doi: 10.1179/1743290113Y.0000000082.
Sun et al., Synthesis and characterization of mechanical-alloyed Ti—xMg alloys. J Alloys Compounds. Jun. 2002;340(1):220-5. doi: 10.1016/S0925-8388(01)02027-8.
Suryanarayana et al., Nanocrystalline titanium-magnesium alloys through mechanical alloying. J Mater Res. Sep. 1990;5(9):1880-6.
Xiao et al., Preparation of W—Cr nano alloying powders with different Cr contents by mechanical alloying. The Chinese Journal of Nongerrous Metals. Nov. 2007;17(11):1779-84. doi: 10.19476/j.ysxb.1004.0609.2007.11.009.
Xu et al., Effect of mechanical alloying on the mechanical property of Y2O3/Cr—Ni composite. Journal of Lanzhou University (Natural Sciences). Oct. 2008;44(5):119-24.
Dobrzanski et al., Structure and properties of cutting tools made from cemented carbides and cermets with the TiN+mono-,gradient-, or multi (Ti,Al,Si)N + TiN nanocrystalline coatings. Mat Process Technol. 2005;164-165:805-15.
Koch at al., Stabilization of nanocrystalline grain sizes by solute additions. Journal of Material Science. Jul. 2008;43(23): 7264-7272.
Trindade et al., Amorphous phase forming ability in(W—C)-based sputtered films. Acta Materialia. Mar. 1998;46(5):1731-9.
Yoshizawa et al., Soft magnetic properties in bulk nanocrystalline alloys fabricated by a shock-wave sintering. Mat Sci Engin A. Mar. 25, 2007;449-51:480-4.
Zhang et al., Spark plasma sintering of soft magnetic Fe—Si—B—P—Cu nanocrystalline alloy in the form of magnetic cores. Mat Trans. Oct. 19, 2011;52(12):2254-7.
Liu et al., Powder metallurgical low-modulus Ti—Mg alloys for biomedical applications. Materials Science and Engineering: C. Nov. 2015;56:241-50. Epub Jun. 15, 2012.
Ladelpha et al., Metallurgical assessment of an emerging A1—Zn—Mg—Cu P/M alloy. Mater Sci Engin. Sep. 15, 2009;520(1-2):105-13.
Raman et al., Oxidation resistance of nanocrystalline vis-á-vis microcrystsalline Fe—Cr alloys. Corr Sci Ox. Feb. 1, 2009;51(2):316-21.
Vajpai et al., Preparation of nanocrystalline Ni—Fe strip via mechanical alloying-compaction-sintering-hot rolling route. J Mat Sci. Jan. 1, 2009; 44(1):129-35.
Zhang et al., First-principles study of solid-solution hardening in steel alloys. Comp Mater Sci. Apr. 30, 2012;55:269-72.
Machio et al., Characterization of mechanically alloyed f.c.c. Ti—Mg-based powders. Powder Technology. 2011;207:387-95. Epub Dec. 3, 2010.
Nakai et al., Exploration of alloying effects of insoluble elements using a non-equilibrium process. Institute of Materials Research. Tohoku University, Japan. Dec. 31, 2015:30-6.
Murray, The MG—Ti (Magnesium-Titanium) System. Bulletin of Alloy Phase Diagrams. 1986;7(3):245-8.
Ohnuma et al., Phase Equilibria in the Ti—A1 Binary System. Acta Mater. Jul. 17, 2000;48:3113-23.
Qureshi et al., Development of Low Density Ternary Ti—MG—B Alloy Via Mechanical Alloying. Mat. Tech & Adv. Perf. Mat. 2002;17(3):160-4. Epub Aug. 25, 2016.
Axelbaum et al., Nano-phase W and W—Ti composite via gas-phase combustion synthesis. Mater Manufact Proc. 1996; 11(6): 1043-53.
Callister, *Materials Science and Engineering: An Introduction*. Fifth Ed., Wiley, 2000: p. 5
Hinds, Determination of gold, palladium and platinum in high purity silver by different solid sampling graphite furnace atomic absorption spectrometry methods. Spectrochim Acta B: Atomic Spectroscopy. Feb. 3, 1993; 48(3): 435-45.
Loos-Neskovic et al., The use of neutron activation for routine analysis of pure iron and chromium. Analytica Chimica Acta. 1976; 85: 95-102.
Xie et al. Development of high performance MgFe alloy as potential biodegradable materials. Materials Science and Engineering A. Aug. 2016; 671: 48-53.
Zhang et al., New progress in developing other ferrous alloys. Innovative Progress Abroad in the Field of Materials. Jun. 2015; 22-3.
Georgeault et al., Comportement au frittage de systemes pulverulents (Ni + Cr) et elaboration des alliages correspondants. Ann. Chim. Fr. 1983;8:203-13.

* cited by examiner

NANOCRYSTALLINE ALLOY PENETRATORS

RELATED APPLICATIONS

This application claims priority under 35 U.S.C. § 119(e) to U.S. Provisional Patent Application Ser. No. 62/220,109, filed Sep. 17, 2015 and entitled "Nanocrystalline Alloy Penetrators," which is incorporated herein by reference in its entirety for all purposes.

GOVERNMENT SPONSORSHIP

This invention was made with Government support under Grant No. W911NF-09-1-0422 awarded by the Army Research Office and under Grant No. HDTRA1-11-1-0062 awarded by the Defense Threat Reduction Agency. The Government has certain rights in the invention.

TECHNICAL FIELD

Nanocrystalline alloy penetrators and related methods and munitions are generally provided.

BACKGROUND

Munitions generally contain a core penetrator which is configured to impact and penetrate a target after a propellant of the munition is activated. Penetrators are generally made from relatively soft materials such as high strength steels which undergo plastic deformation during impact and/or penetration. However, munitions which contain materials that do not undergo such deformation remain elusive. Accordingly, additional materials and methods would be desirable.

SUMMARY

The present disclosure describes nanocrystalline alloy penetrators. Related methods and munitions are also described. According to certain embodiments, the alloy penetrators comprise at least one of tungsten and chromium.

In one aspect, munitions are provided. In some embodiments, the munition comprises a propellant contained within a cavity of the munition and a penetrator. In certain embodiments, the penetrator comprises a nanocrystalline alloy comprising at least one of W and Cr, wherein the nanocrystalline alloy has a cross-sectional average grain size of less than or equal to about 100 nm. In some embodiments, the penetrator comprises a nanocrystalline alloy comprising at least one of W and Cr, wherein the nanocrystalline alloy does not contain iron or contains iron in an amount of less than 3.8 at %. In some embodiments, the penetrator comprises a nanocrystalline alloy comprising at least one of W and Cr, wherein the nanocrystalline alloy has grains with an aspect ratio of less than about 2.

In another aspect, methods are provided. In some embodiments, the method comprises associating, with a propellant, a penetrator comprising a plurality of sintered nanocrystalline particulates that form a nanocrystalline alloy. In some embodiments, before the nanocrystalline particulates are sintered, at least some of the nanocrystalline particulates comprise a non-equilibrium phase comprising a first metal material and a second metal material, and the first metal material is dissolved in the second metal material. In certain embodiments, the total amount of the first metal material in the nanocrystalline particulates is greater than the total amount of the second metal material in the nanocrystalline particulates. In some embodiments, the sintering involves a first sintering temperature, and the first sintering temperature is lower than a second sintering temperature needed for sintering the first metal material in the absence of the second metal material.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosure, the present specification shall control.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Nanocrystalline alloy penetrators and related methods are generally provided. In some embodiments, a munition comprises a nanocrystalline alloy penetrator. In certain embodiments, the nanocrystalline alloy has particular properties (e.g., grain size, grain isotropy, and/or one or more mechanical properties) such that the penetrator acts as a rigid body kinetic penetrator. Certain of the penetrators described herein can be produced relatively easily, for example, in a sintering process that requires little or no applied pressure. Certain embodiments described herein take advantage of methods of performing sintering such that undesired grain growth does not occur during the sintering process.

The term "penetrator" as used herein generally refers to a projectile which is configured to impact and penetrate a desired target. The munitions described herein generally comprise a penetrator and a propellant (e.g., an explosive or other propellant). The propellant can be configured to, upon activation of the propellant (e.g., explosion of an explosive propellant), project the penetrator along a trajectory. The munition can be configured, according to certain embodiments, such that when the propellant is activated, the penetrator is projected such that it impacts and penetrates a target. Certain of the munitions described herein may be useful in a variety of applications including military uses, mechanical impact testing of materials, and ballistic testing. Non-limiting examples of munitions include firearm cartridges, shells, missiles, warheads, and fragmenting rounds.

According to some, although not necessarily all embodiments, certain of the penetrators described herein (e.g., comprising a nanocrystalline alloy) may offer one or more advantages including, in some cases, rigid body penetration of a relatively hard material such as cement (e.g., concrete), aluminum (e.g., an aluminum alloy) and/or geomaterials (e.g., hard clay) at relatively high velocities (e.g., 1.0 km/s), as compared to traditional penetrators which generally undergo plastic deformation during impact with such materials. Penetrators and related materials and methods are described in more detail, below.

Certain of the munitions described herein comprise a penetrator (e.g., comprising a nanocrystalline alloy) and a propellant. Propellants are described in more detail, below. In certain embodiments, the munition comprises a housing, described in more detail below, although it should be understood that the housing is optional. For example, in some embodiments, the munition does not include a housing, and the penetrator can include a cavity in which the propellant is positioned.

Figure 1A:
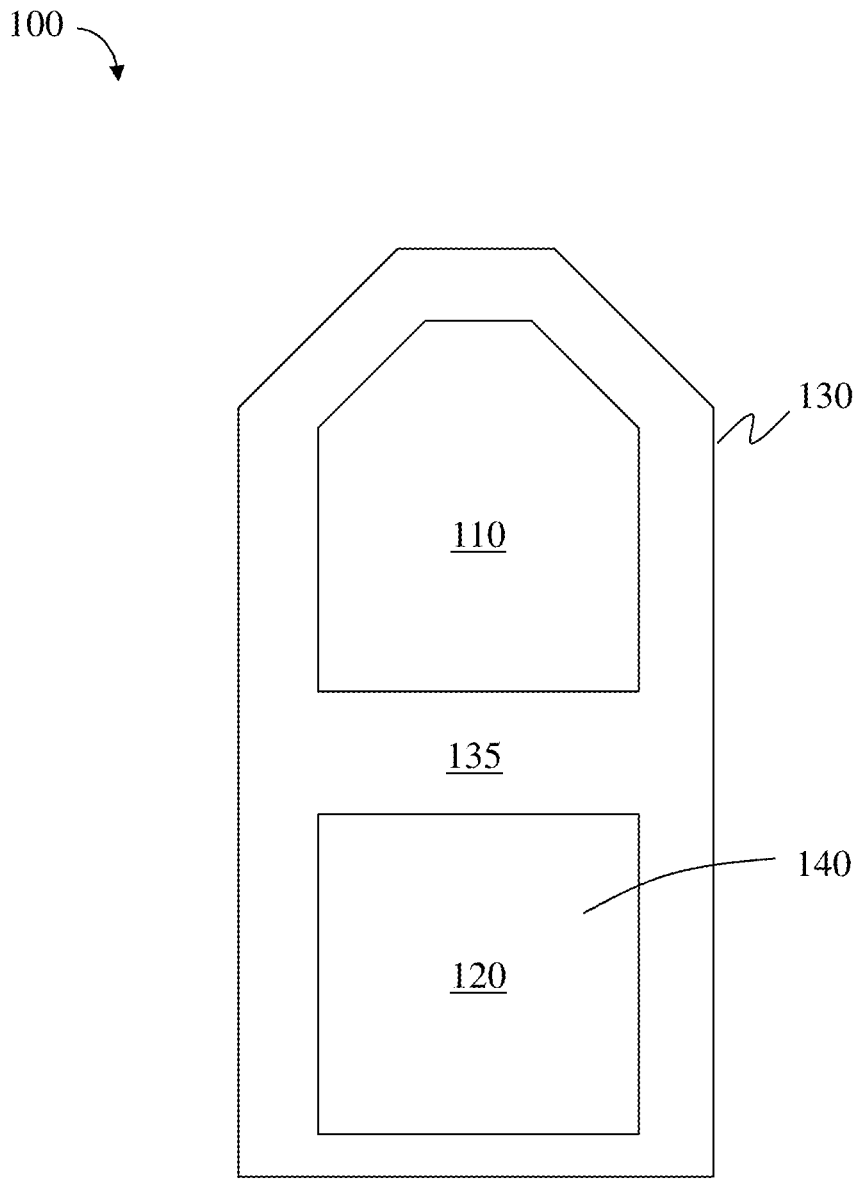
FIG. 1A is a cross-sectional schematic diagram of a munition, according to some embodiments.

The penetrator and the propellant can be associated with each other in a variety of configurations. One such configuration of a munition is illustrated in FIG. 1A. In FIG. 1A, munition 100 comprises penetrator 110 associated with propellant 120. Munition 100 in FIG. 1A also includes housing 130.

Figure 1B:
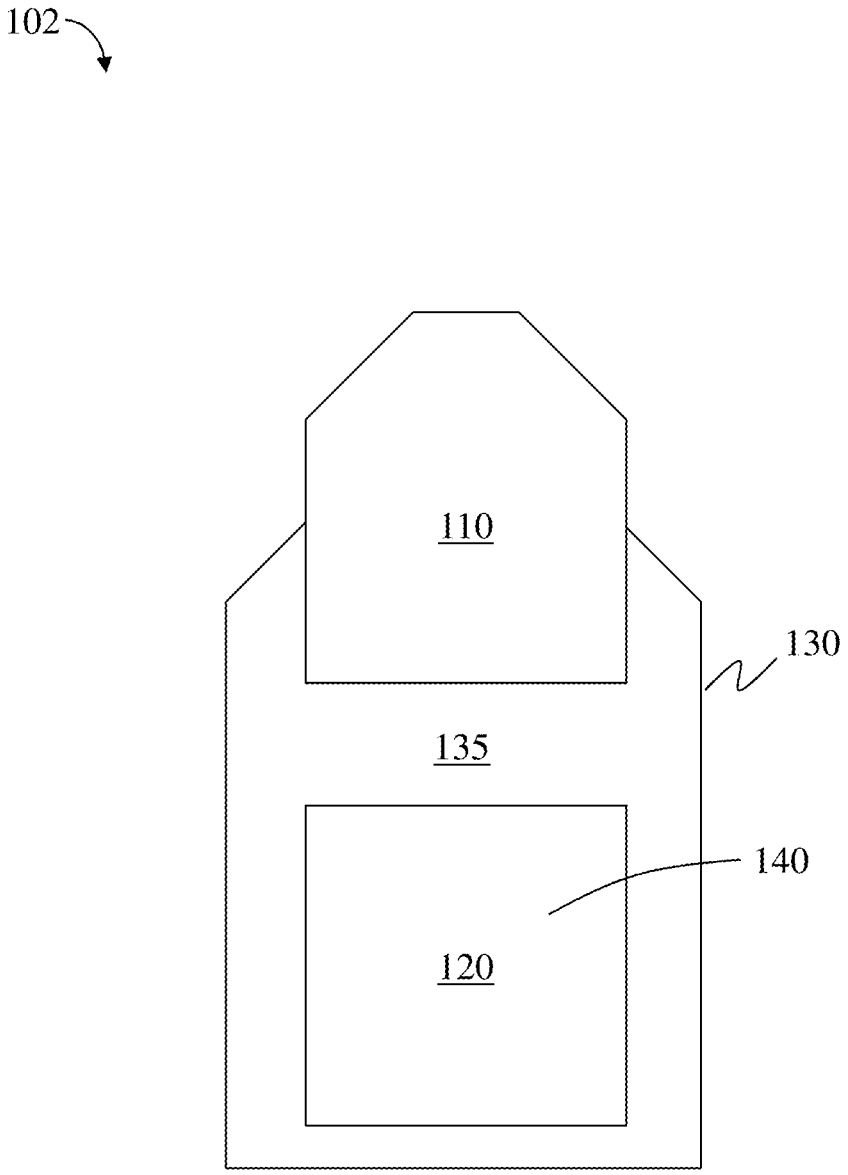
FIG. 1B is, according to certain embodiments, a cross-sectional schematic diagram of a munition.

FIG. 1B is a cross-sectional schematic illustration of another exemplary munition. In FIG. 1B, munition 102 includes penetrator 110 associated with propellant 120 via housing 130. In FIG. 1B, a portion of penetrator 110 is exposed to the external environment, and is not covered by housing 130.

Figure 1C:
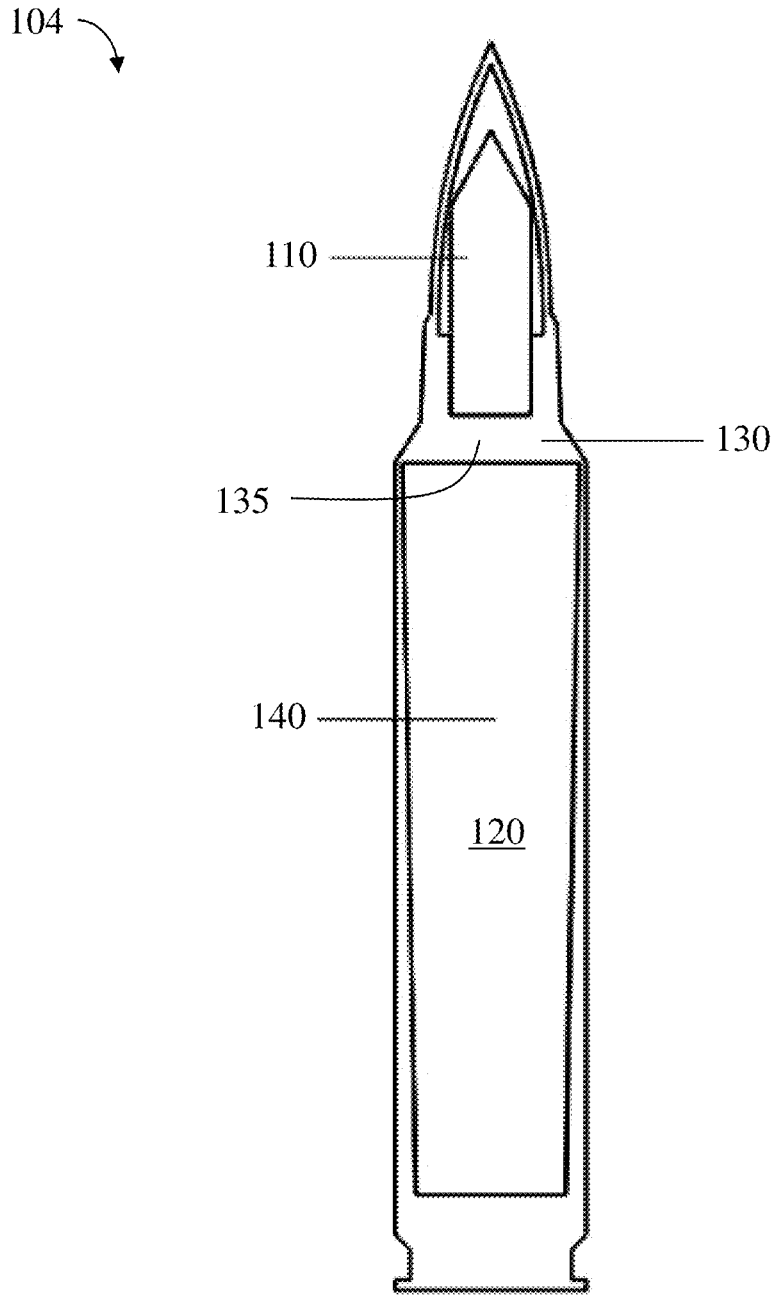
FIG. 1C is a cross-sectional schematic illustration of a firearm cartridge, according to certain embodiments.

FIG. 1C is a cross-sectional schematic illustration of another exemplary munition 104. In FIG. 1C, munition 104 includes penetrator 110 associated with propellant 120 via housing 130. Munition 104 illustrated in FIG. 1C can correspond to, for example, a rifle cartridge. In some such embodiments, propellant 120 can comprise gun powder, and penetrator 110 can correspond to a bullet. Housing 130 in FIG. 1C can correspond to the casing of the cartridge, according to certain embodiments.

Figure 1D:
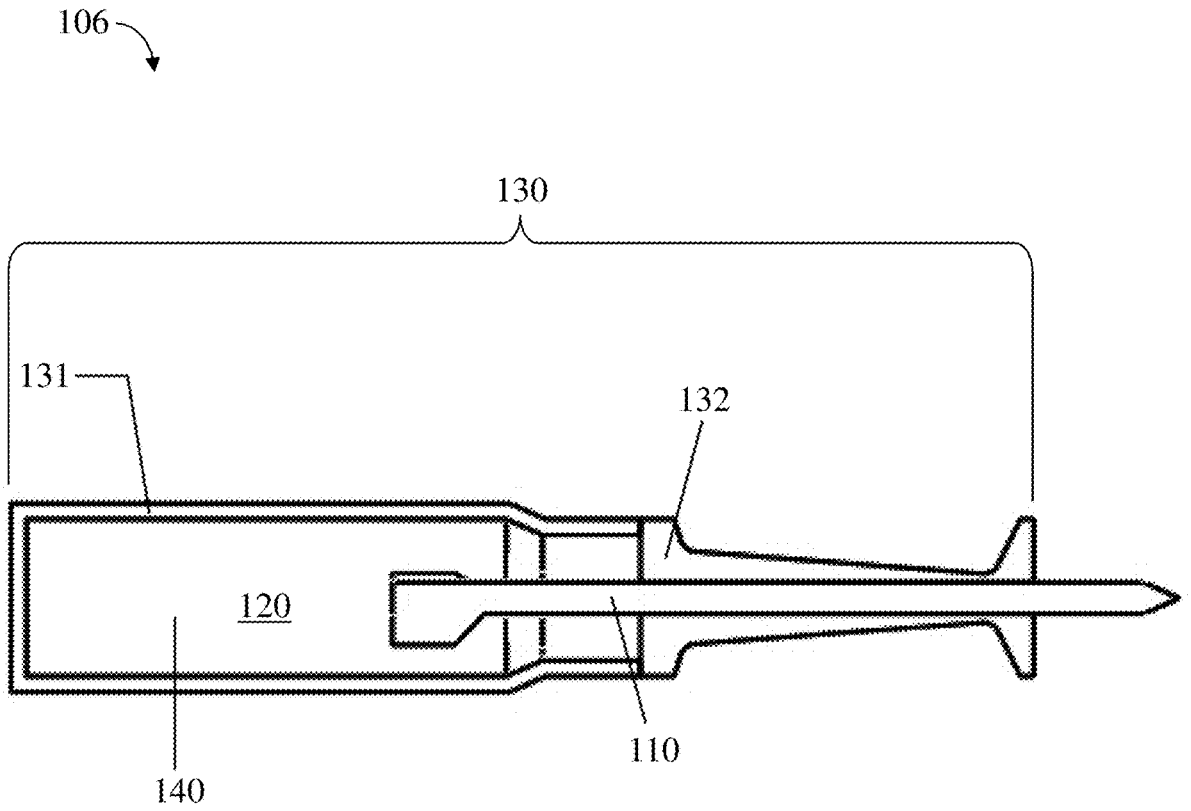
FIG. 1D is, according to some embodiments, a cross-sectional schematic illustration of a kinetic energy penetrator munition.

FIG. 1D is a cross-sectional schematic illustration of another exemplary munition 106. In FIG. 1D, munition 106 includes penetrator 110 associated with propellant 120 via casing 131 and sabot 132. Together, casing 131 and sabot 132 can define housing 130. Munition 106 illustrated in FIG. 1D can correspond to, for example, a kinetic energy penetrator munition.

Figure 1E:
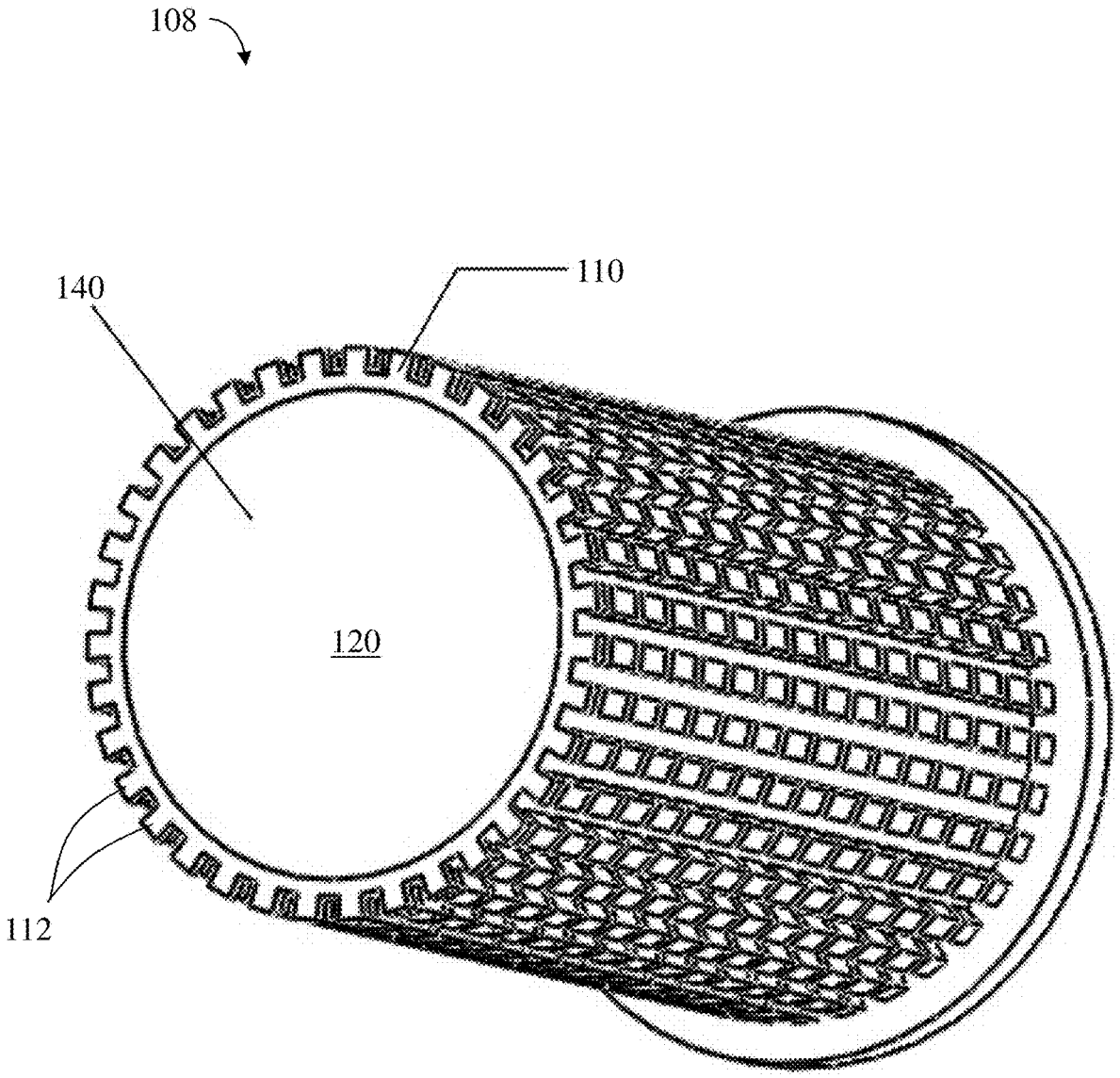
FIG. 1E is a cross-sectional schematic illustration of a fragmenting round, according to certain embodiments.

FIG. 1E is a cross-sectional schematic illustration of another exemplary munition 108. Munition 108 of FIG. 1E comprises penetrator 110 and propellant 120 positioned within a cavity of penetrator 110. Munition 108 of FIG. 1E can correspond to a fragmenting round, according to certain embodiments. In some embodiments, munition 108 can include an optional housing, which can contact the penetrator and/or the propellant. In other embodiments, munition 108 does not include a housing.

According to certain embodiments, the propellant is arranged such that it is in direct contact with at least a surface of the penetrator. For example, as illustrated in FIG. 1D, propellant 120 and penetrator 110 are in direct contact (although they need not necessarily be so). As another example, as illustrated in FIG. 1E, propellant 120 and penetrator 110 are in direct contact (although they need not necessarily be so).

In certain embodiments, the propellant and the penetrator are separated by at least one layer in direct physical contact with the penetrator and the propellant. For example, as illustrated in FIGS. 1A-1C, penetrator 110 and propellant 120 are separated by layer 135, which is in direct contact with both penetrator 110 and propellant 120. Of course, in other embodiments, the munitions in FIGS. 1A-1C can include penetrators and propellants that are in direct contact with each other. In addition, while a single material is illustrated as separating penetrator 110 and propellant 120 in FIGS. 1A-1C, in other cases, multiple materials (e.g., a multi-layer arrangement of materials or another arrangement of a material composite) may separate penetrator 110 and propellant 120.

According to certain embodiments, the munition comprises a cavity. In some such embodiments, the propellant is contained within the cavity of the munition. For example, in FIGS. 1A-1E, munition 100 comprises cavity 140, and propellant 120 is contained within cavity 140. In some embodiments, the cavity containing the propellant is defined, at least in part, by the housing of the munition. For example, in FIGS. 1A-1D, housing 130 defines cavity 140, within which propellant 120 is contained. In certain embodiments, the cavity containing the propellant is defined, at least in part, by the penetrator of the munition. For example, in FIGS. 1A-1D, penetrator 110 defines cavity 140, within which propellant 120 is contained.

In some embodiments in which a housing is present, the penetrator may be at least partially contained within the housing. In some such embodiments, a first portion of the penetrator may be exposed, and a second portion of the penetrator may be contained within the housing. For example, as shown in FIG. 1B, munition 102 comprises penetrator 110 is partially contained by housing 130. As another example, as illustrated in FIG. 1D, munition 106 comprises penetrator 110, which is partially contained by housing 130. In other embodiments, the penetrator is fully contained within the housing. For example, as illustrated in FIG. 1A, munition 100 comprises penetrator 110, which is fully contained within a cavity of housing 130. As another example, as illustrated in FIG. 1C, munition 104 comprises penetrator 110, which is fully contained within a cavity of housing 130.

In some cases, the munition comprises a plurality of penetrator portions arranged in an array around a propellant. For example, referring to FIG. 1E, munition 108 can be a fragmenting round. In some such embodiments, penetrator 110 comprises an array of portions 112 arranged in an array around propellant 120. The penetrator portions can be configured, according to certain embodiments, such that at least some of the portions are mechanically separated from other portions upon activation (e.g., ignition) of the propellant. Such configurations may be used, for example, when the munition is used as a fragmenting round.

The housing, when present, generally contacts the propellant and the penetrator of the munition. The housing may be used to maintain the relative position of the propellant and the penetrator within the munition. As noted above, the housing can, according to certain embodiments, include a cavity that contains the propellant. Also as noted above, the housing may also contain at least a portion of the penetrator.

In some embodiments, the housing may be configured such that the munition (including the propellant, the penetrator, and the housing) may be loaded into a device for projecting the penetrator (e.g., a firearm).

When present, the layer separating the penetrator and the propellant can be part of the housing. The layer separating the propellant and the penetrator may be made of the same material as the rest of the housing, or it may be made from a different material from the rest of the housing.

According to certain embodiments, the housing is made of a single material. The single material can be in the form of a unitary body, as illustrated, for example, in FIGS. 1A-1C, or it may be arranged as a composite, with multiple pieces fitting together to form the housing, as illustrated in FIG. 1D. In other embodiments, the housing is made of multiple materials, which may be in the form of a unitary body or separable components. In certain embodiments, the housing corresponds to a case of a firearm cartridge or the packaging of a shell (e.g., an artillery shell). Those of ordinary skill in the art would be capable of selecting suitable materials for the housing including, but not limited to, brass, copper, steel, aluminum, polymers, paper, and combinations thereof. In certain embodiments, the housing, the penetrator, and the propellant can together form at least a portion of a firearm cartridge. In certain embodiments, the housing, the penetrator, and the propellant can together form at least a portion of a shell munition.

In certain embodiments, the combined volume of the penetrator, the propellant, and the housing, when assembled in the munition, is at least about 1 $mm^3$, at least about 5 $mm^3$, at least about 10 $mm^3$, at least about 0.1 $cm^3$, at least about 0.5 $cm^3$, at least about 0.8 $cm^3$, or at least about 1 $cm^3$. In some embodiments, the combined volume of the penetrator, the propellant, and the housing, when assembled in the munition is less than about 1 $m^3$, less than about 100 $cm^3$, less than about 50 $cm^3$, less than about 25 $cm^3$, less than about 10 $cm^3$, or less than about 5 $cm^3$. Combinations of these ranges are also possible. The combined volume of the penetrator, the propellant, and the housing, when assembled in the munition, may also have a volume outside these ranges. The combined volume of the penetrator, the propellant, and the housing, when assembled in the munition, is determined by measuring the volume of liquid water that is displaced when the assembled penetrator, propellant, and housing are fully submerged in the liquid water.

In certain embodiments, the penetrator, the propellant, and the optional housing can be integrated with each other so as to form a single body. In some embodiments, the penetrator and the propellant can be integrated with each other such that separating the penetrator and the propellant cannot be achieved without fracturing or plastically deforming the penetrator and/or an optional housing associated with the penetrator and the propellant.

As described above, in some embodiments, the munition comprises a propellant. Propellants are generally known in the art and may include any material suitable for projecting the penetrator and, in some cases, the housing. According to certain embodiments, the propellant comprises an explosive. Those skilled in the art would be capable of selecting suitable materials for the propellant based upon the desired application and the teachings of this specification. Non-limiting examples of suitable propellants include liquid propellant (such as gasoline), gunpowder, nitrocellulose, cordite, ballistite, and composite propellants including powdered metal and an oxidizer (e.g., ammonium perchlorate, ammonium nitrate).

The penetrators described herein generally comprise a nanocrystalline material such as a nanocrystalline alloy. Nanocrystalline alloys (e.g., having nanocrystalline grains) offer, according to certain but not necessarily all embodiments, one or more advantages over alloys or materials used in traditional penetrators (e.g., having ultra-fine or larger grains). For example, in some cases, the penetrators described herein can provide rigid body penetration in relatively hard materials over a wide range of impact velocities. Without wishing to be bound by any particular theory, nanocrystalline alloys with relatively small grain sizes (e.g., in some cases, less than about 100 nm) can have a relatively high number of grain boundaries which, in combination with appropriate material selection, can make the penetrator particularly resistant to mechanical deformation in penetration applications. In certain embodiments, the penetrator can be projected at a 6061-T6511 Aluminum target, striking the target at a velocity of 1 km/s, such that after the penetrator comes to rest after striking the target, the largest cross-sectional dimension of the penetrator that was orthogonal to the target at impact is at least about 95% (or at least about 98%, or at least about 99%) of its original value. In some embodiments, the penetrator can be projected at a 6061-T6511 Aluminum target, striking the target at a velocity of 1 km/s, such that after the penetrator comes to rest after striking the target, the penetrator has a maximum width that is less than about 105% (or less than about 102%, or less than about 101%) of the maximum width just prior to striking the target. In some embodiments, the penetrator can be projected at a 6061-T6511 Aluminum target, striking the target at a velocity of 1 km/s, such that after the penetrator comes to rest after striking the target, the maximum cross-sectional dimension of the penetrator is within about 5% (or within about 2%, or within about 1%) of its original length, as measured relative to its original length. For the purpose of these screening tests, the maximum width of the penetrator is the maximum dimension of the penetrator that was parallel to the target at impact. Additionally, for the purposes of these screening tests, the 6061-T6511 Aluminum target is sufficiently large that it acts as a semi-infinite body, which is to say, the target has a sufficient depth and facial area such that further increases in depth and facial area do not affect the test result. In some embodiments, the penetrator satisfies at least one (or at least two, or all three) of these screening tests when the largest-cross sectional dimension of the penetrator is within 5 degrees (or within 2 degrees, or within 1 degree) of orthogonal to the target surface at impact.

According to certain embodiments, the penetrator comprises a bulk material. Bulk materials are those materials which are not thin films. In some embodiments, the smallest cross sectional dimension of the penetrator that intersects the geometric center of the penetrator is at least about 100 microns, at least about 1 millimeter, or at least about 5 millimeters.

In certain embodiments, the nanocrystalline alloy of the penetrator is a bulk material. In some embodiments, the smallest cross sectional dimension of the nanocrystalline alloy that intersects the geometric center of the nanocrystalline alloy is at least about 100 microns, at least about 1 millimeter, or at least about 5 millimeters.

In certain embodiments, the penetrator (and, in some cases, the nanocrystalline alloy portion of the penetrator) occupies a volume of at least about 1 $mm^3$, at least about 5

$mm^3$, at least about 10 $mm^3$, at least about 0.1 $cm^3$, at least about 0.5 $cm^3$, at least about 0.8 $cm^3$, or at least about 1 $cm^3$. In some embodiments, the penetrator (and, in some cases, the nanocrystalline alloy portion of the penetrator) occupies a volume of less than about 1 $m^3$, less than about 100 $cm^3$, less than about 50 $cm^3$, less than about 25 $cm^3$, less than about 10 $cm^3$, or less than about 5 $cm^3$. Combinations of these ranges are also possible. The penetrator may also have a volume outside these ranges. The volume of the penetrator (or the nanocrystalline alloy portion of the penetrator) is determined by measuring the volume of liquid water that is displaced when the penetrator (or the nanocrystalline alloy portion of the penetrator) is fully submerged in the liquid water.

In some embodiments, at least about 50% by weight (i.e., wt %), at least about 60 wt %, at least about 70 wt %, at least about 80 wt %, at least about 90 wt %, at least about 95 wt %, or more, of the penetrator is made up of the nanocrystalline alloy.

The term "nanocrystalline material" as used herein generally refers to materials that comprise at least some grains with a size of less than or equal to about 1000 nm. The grain size of an individual grain within a nanocrystalline alloy corresponds to the largest cross-sectional dimension of the grain. In some embodiments, a nanocrystalline material (e.g., a nanocrystalline alloy) can contain at least some grains with a size of less than or equal to about 900 nm, about 800 nm, about 700 nm, about 600 nm, about 500 nm, about 400 nm, about 300 nm, about 200 nm, about 150 nm, about 100 nm, about 50 nm, about 30 nm, about 20 nm, about 10 nm, about 5 nm, about 2 nm, or smaller. The term "ultra-fine grain" is generally used herein to denote a grain size of greater than about 100 nm and less than about 1000 nm, and the term "nanocrystalline grain" is used to denote a grain size of less than or equal to about 100 nm. "Nanocrystalline alloys" are nanocrystalline materials that are alloys. In some embodiments, the number average of the grain sizes of the individual grains within the nanocrystalline alloy is less than or equal to about 1000 nm (or less than or equal to about 900 nm, about 800 nm, about 700 nm, about 600 nm, about 500 nm, about 400 nm, about 300 nm, about 200 nm, about 150 nm, about 100 nm, about 50 nm, about 30 nm, about 20 nm, about 10 nm, about 5 nm, about 2 nm, or smaller).

According to certain embodiments, the penetrator can comprise a nanocrystalline alloy, and the nanocrystalline alloy of the penetrator can have a relatively small cross-sectional average grain size. In some embodiments, the nanocrystalline alloy has a cross-sectional average grain size of less than or equal to about 100 nm, less than or equal to about 90 nm, less than or equal to about 80 nm, less than or equal to about 75 nm, less than or equal to about 60 nm, less than or equal to about 50 nm, less than or equal to about 40 nm, less than or equal to about 30 nm, less than or equal to about 20 nm, less than or equal to about 10 nm, less than or equal to about 5 nm, less than or equal to about 2 nm, or less than or equal to about 1 nm. In certain embodiments, the nanocrystalline alloy has a cross-sectional average grain size of greater than about 0.5 nm, greater than about 1 nm, greater than about 2 nm, greater than about 5 nm, greater than about 10 nm, greater than about 20 nm, greater than about 30 nm, greater than about 40 nm, greater than about 50 nm, greater than about 60 nm, greater than about 70 nm, or greater than about 75 nm. Combinations of the above-referenced ranges are also possible (e.g., between about 0.5 nm and about 100 nm, between about 1 nm and about 50 nm, between about 20 nm and about 75 nm, between about 30 nm and about 100 nm). Other ranges are also possible.

An object is said to have a "cross-sectional average grain size" falling within a particular range if at least one cross-section of the object that intersects the geometric center of the object has a volume-average grain size falling within that range. For example, an object having a cross-sectional average grain size of less than about 100 nm would include at least one cross-section that intersects the geometric center of the object having a volume-average grain size of less than about 100 nm. An object having a cross-sectional grain size of between about 0.5 nm and about 100 nm would include at least one cross-section that intersects the geometric center of the object having a volume-average grain size of between about 0.5 nm and about 100 nm.

The volume-average grain size of a cross-section of an object is measured by obtaining the cross-section of the object, tracing the perimeter of each grain in an image of the cross-section of the object (which may be a magnified image, such as an image obtained from a transmission electron microscope), and calculating the circular-equivalent diameter, $D_i$, of each traced grain cross-section. The "circular-equivalent diameter" of a grain cross-section corresponds to the diameter of a circle having an area (A, as determined by $A=\pi r^2$) equal to the cross-sectional area of the grain in the cross-section of the object. The volume-average grain size (D) is calculated as:

$$D = \left( \frac{\sum_{i=1}^{i=n} D_i^3}{n} \right)^{1/3}$$

where n is the number of grains in the cross-section and $D_i$ is the circular-equivalent diameter of grain i.

According to certain embodiments, an object having a cross-sectional average grain size falling within a particular range (e.g., any of the ranges described elsewhere herein) has a first cross-section intersecting the geometric center of the object and having a volume-average grain size falling within that range, and at least a second cross-section—orthogonal to the first cross-section—intersecting the geometric center of the object and having a volume-average grain size falling within that range. For example, according to certain embodiments, an object having a cross-sectional average grain size of less than about 100 nm includes a cross-section that intersects the geometric center of the object having a volume-average grain size of less than about 100 nm and at least a second cross-section—orthogonal to the first cross-section—intersecting the geometric center of the object and having a volume-average grain size of less than about 100 nm. As another example, according to some embodiments, an object having a cross-sectional average grain size of between about 0.5 nm and about 100 nm includes a cross-section that intersects the geometric center of the object having a volume-average grain size of between about 0.5 nm and about 100 nm and at least a second cross-section—orthogonal to the first cross-section—intersecting the geometric center of the object and having a volume-average grain size of between about 0.5 nm and about 100 nm.

In some embodiments, an object having a cross-sectional average grain size falling within a particular range (e.g., any of the ranges described elsewhere herein) has a first cross-section intersecting the geometric center of the object and having a volume-average grain size falling within that range, a second cross-section—orthogonal to the first cross-section—intersecting the geometric center of the object and having a volume-average grain size falling within that range, and at least a third cross-section—orthogonal to the first cross-section and orthogonal to the second cross-section—intersecting the geometric center of the object and having a volume-average grain size falling within that range. For example, according to certain embodiments, an object having a cross-sectional average grain size of less than about 100 nm includes a first cross-section that intersects the geometric center of the object having a volume-average grain size of less than about 100 nm, a second cross-section—orthogonal to the first cross-section—intersecting the geometric center of the object and having a volume-average grain size of less than about 100 nm, and at least a third cross-section—orthogonal to the first cross-section and orthogonal to the second cross-section—intersecting the geometric center of the object and having a volume-average grain size of less than about 100 nm. As another example, according to some embodiments, an object having a cross-sectional average grain size of between about 0.5 nm and about 100 nm includes a first cross-section that intersects the geometric center of the object having a volume-average grain size of between about 0.5 nm and about 100 nm, a second cross-section—orthogonal to the first cross-section—intersecting the geometric center of the object and having a volume-average grain size of between about 0.5 nm and about 100 nm, and at least a third cross-section—orthogonal to the first cross-section and orthogonal to the second cross-section—intersecting the geometric center of the object and having a volume-average grain size of between about 0.5 nm and about 100 nm.

In some embodiments, the nanocrystalline alloy of the penetrator comprises grains having relatively equiaxed grains. In certain embodiments, at least a portion of the grains within the nanocrystalline alloy have aspect ratios of less than about 2, less than about 1.8, less than about 1.6, less than about 1.4, less than about 1.3, less than about 1.2, or less than about 1.1 (and, in some embodiments, down to about 1). The aspect ratio of a grain is calculated as the maximum cross-sectional dimension of the grain which intersects the geometric center of the grain, divided by the dimension of the grain that is orthogonal to the maximum cross-sectional dimension of the grain. The aspect ratio of a grain is expressed as a single number, with 1 corresponding to an equiaxed grain. In some embodiments, the number average of the aspect ratio of the grains in the nanocrystalline alloy is less than about 2, less than about 1.8, less than about 1.6, less than about 1.4, less than about 1.3, less than about 1.2, or less than about 1.1 (and, in some embodiments, down to about 1).

Without wishing to be bound by any particular theory, it is believed that relatively equiaxed grains may be present when the nanocrystalline alloy is produced in the absence (or substantial absence) of applied pressure (e.g., via a pressureless or substantially pressureless sintering process).

In certain embodiments, the nanocrystalline alloy comprises a relatively low cross-sectional average grain aspect ratio. In some embodiments, the cross-sectional average grain aspect ratio in the nanocrystalline alloy is less than about 2, less than about 1.8, less than about 1.6, less than about 1.4, less than about 1.3, less than about 1.2, or less than about 1.1 (and, in some embodiments, down to about 1).

The cross-sectional average grain aspect ratio of a particular object is said to fall within a particular range if at least one cross-section of the object that intersects the geometric center of the object is made up of grain cross-sections with an average aspect ratio falling within that range. For example, the cross-sectional average grain aspect ratio of a particular object would be less than about 2 if the object includes at least one cross-section that intersects the geometric center of the object an in which the cross-section is made up of grain cross-sections with an average aspect ratio of less than about 2.

To determine the average aspect ratio of the grain cross-sections from which the cross-section of the object is made up (also referred to herein as the "average aspect ratio of grain cross-sections"), one obtains the cross-section of the object, traces the perimeter of each grain in an image of the cross-section of the object (which may be a magnified image, such as an image obtained from a transmission electron microscope), and calculates the aspect ratio of each traced grain cross-section. The aspect ratio of a grain cross-section is calculated as the maximum cross-sectional dimension of the grain cross-section (which intersects the geometric center of the grain cross-section), divided by the dimension of the grain cross-section that is orthogonal to the maximum cross-sectional dimension of the grain cross-section. The aspect ratio of a grain cross-section is expressed as a single number, with 1 corresponding to an equiaxed grain cross-section. The average aspect ratio of the grain cross-sections from which the cross-section of the object is made up ($AR_{avg}$) is calculated as a number average:

$$AR_{avg} = \frac{\sum_{i=1}^{i=n} AR_i}{n}$$

where n is the number of grains in the cross-section and $AR_i$ is the aspect ratio of the cross-section of grain i.

According to certain embodiments, an object having a cross-sectional average grain aspect ratio falling within a particular range (e.g., any of the ranges described elsewhere herein) has a first cross-section intersecting the geometric center of the object and having an average aspect ratio of grain cross-sections falling within that range, and at least a second cross-section—orthogonal to the first cross-section—intersecting the geometric center of the object and having an average aspect ratio of grain cross-sections falling within that range. For example, according to certain embodiments, an object having a cross-sectional average grain aspect ratio of less than about 2 includes a cross-section that intersects the geometric center of the object having an average aspect ratio of grain cross-sections of less than about 2 and at least a second cross-section—orthogonal to the first cross-section—intersecting the geometric center of the object and having an average aspect ratio of grain cross-sections of less than about 2.

According to certain embodiments, an object having a cross-sectional average grain aspect ratio falling within a particular range (e.g., any of the ranges described elsewhere herein) has a first cross-section intersecting the geometric center of the object and having an average aspect ratio of grain cross-sections falling within that range, a second cross-section—orthogonal to the first cross-section—intersecting the geometric center of the object and having an average aspect ratio of grain cross-sections falling within that range, and at least a third cross-section—orthogonal to the first cross-section and the second cross-section—intersecting the geometric center of the object and having an average aspect ratio of grain cross-sections falling within that range. For example, according to certain embodiments, an object having a cross-sectional average grain aspect ratio of less than about 2 includes a first cross-section that intersects the geometric center of the object having an average aspect ratio of grain cross-sections of less than about 2, a second cross-section—orthogonal to the first cross-section—intersecting the geometric center of the object and having an average aspect ratio of grain cross-sections of less than about 2, and at least a third cross-section—orthogonal to the first cross-section and the second cross-section—intersecting the geometric center of the object and having an average aspect ratio of grain cross-sections of less than about 2.

According to certain embodiments, the grains within the nanocrystalline alloy can be both relatively small and relatively equiaxed. For example, according to certain embodiments, at least one cross-section (and, in some embodiments, at least a second cross-section that is orthogonal to the first cross-section and/or at least a third cross-section that is orthogonal to the first and second cross-sections) can have a volume average grain size and an average aspect ratio of grain cross-sections falling within any of the ranges outlined above or elsewhere herein.

In some embodiments, the nanocrystalline alloy of the penetrator is stabilized against grain growth at relatively high temperatures. An object is said to be stabilized against grain growth at a particular temperature when the object includes at least one cross-section intersecting the geometric center of the object in which the volume-average grain size of the cross-section does not increase by more than 20% (relative to the original volume-average grain size) when the object is heated to that temperature for 24 hours in an argon atmosphere. One of ordinary skill in the art would be capable of determining whether an object is stabilized against grain growth at a particular temperature by taking a cross-section of the article, determining the volume-average grain size of the cross-section at 25° C., heating the cross-section to the particular temperature for 24 hours in an argon atmosphere, allowing the cross-section to cool back to 25° C., and determining—post-heating—the volume-average grain size of the cross-section. The object would be said to be stabilized against grain growth if the volume-average grain size of the cross-section after the heating step is less than 120% of the volume-average grain size of the cross-section prior to the heating step. According to certain embodiments, an object that is stabilized against grain growth at a particular temperature includes at least one cross-section intersecting the geometric center of the object in which the volume-average grain size of the cross-section does not increase by more than about 15%, more than about 10%, more than about 5%, or more than about 2% (relative to the original volume-average grain size) when the object is heated to that temperature for 24 hours in an argon atmosphere. In some embodiments, the nanocrystalline alloy is stable against grain growth at at least one temperature greater than or equal to about 1000° C., greater than or equal to about 1050° C., greater than or equal to about 1100° C., greater than or equal to about 1150° C., greater than or equal to about 1200° C., greater than or equal to about 1250° C., greater than or equal to about 1300° C., greater than or equal to about 1350° C., greater than or equal to about 1400° C., or greater than or equal to about 1450° C. In some embodiments, the nanocrystalline alloy is stable against grain growth at all temperatures between about 1000° C. and about 1050° C., between about 1000° C. and about 1100° C., between about 1000° C. and about 1150° C., between about 1000° C. and about 1200° C., between about 1000° C. and about 1250° C., between about 1000° C. and about 1300° C., between about 1000° C. and about 1350° C., between about 1000° C. and about 1400° C., or between about 1000° C. and about 1450° C. Other ranges are also possible.

In some embodiments, the object includes at least one cross-section intersecting the geometric center of the object in which the volume-average grain size of the cross-section does not grow to more than 500 nm (or, in some cases, to more than 200 nm, to more than 100 nm, or to more than 50 nm) when the object is heated for 24 hours, in an argon atmosphere, to at least one temperature greater than or equal to about 1000° C., greater than or equal to about 1050° C., greater than or equal to about 1100° C., greater than or equal to about 1150° C., greater than or equal to about 1200° C., greater than or equal to about 1250° C., greater than or equal to about 1300° C., greater than or equal to about 1350° C., greater than or equal to about 1400° C., or greater than or equal to about 1450° C.

In some embodiments, the nanocrystalline alloy has a relatively high relative density. The term "relative density" as used herein is given its ordinary meaning in the art and generally refers to the ratio of the experimentally measured density of the nanocrystalline alloy and the maximum theoretical density of the nanocrystalline alloy. The "relative density" ($\rho_{rel}$) is expressed as a percentage, and is calculated as:

$$\rho_{rel} = \frac{\rho_{measured}}{\rho_{maximum}} \times 100\%$$

wherein $\rho_{measured}$ is the experimentally measured density of the nanocrystalline alloy and $\rho_{maximum}$ is the maximum theoretical density of an alloy having the same composition as the nanocrystalline alloy.

In some embodiments, the relative density of the nanocrystalline alloy of the penetrator is greater than or equal to about 75%, greater than or equal to about 80%, greater than or equal to about 85%, greater than or equal to about 90%, greater than or equal to about 92%, greater than or equal to about 94%, greater than or equal to about 96%, greater than or equal to about 98%, greater than or equal to about 99%, or greater than or equal to about 99.5% (and/or, in certain embodiments, up to about 99.8%, up to about 99.9%, or more). In some embodiments, the nanocrystalline alloy has a relative density of about 100%.

The nanocrystalline alloy of the penetrator generally comprises at least two metals. In some embodiments, the nanocrystalline alloy comprises at least three metals, at least four metals, or more.

In some embodiments, the nanocrystalline alloy of the penetrator comprises a first metal material and a second metal material. The first and/or second metal material may comprise a first and/or second metal element, respectively. The term "element" is used herein to refer to an atomic element of the Periodic Table of the Elements (also referred to herein as the Periodic Table). The first metal material may be a metal element. A metal element may include any of the elements in Groups 3-14 of the Periodic Table. In some embodiments, the metal element (e.g., of the first metal material and/or the second metal material) may be a refractory metal element (e.g., Nb, Ta, Mo, W, and/or Re). In certain embodiments, the metal element is a transition metal (i.e., any of those in Groups 3-12 of the periodic table).

Figure 5A:
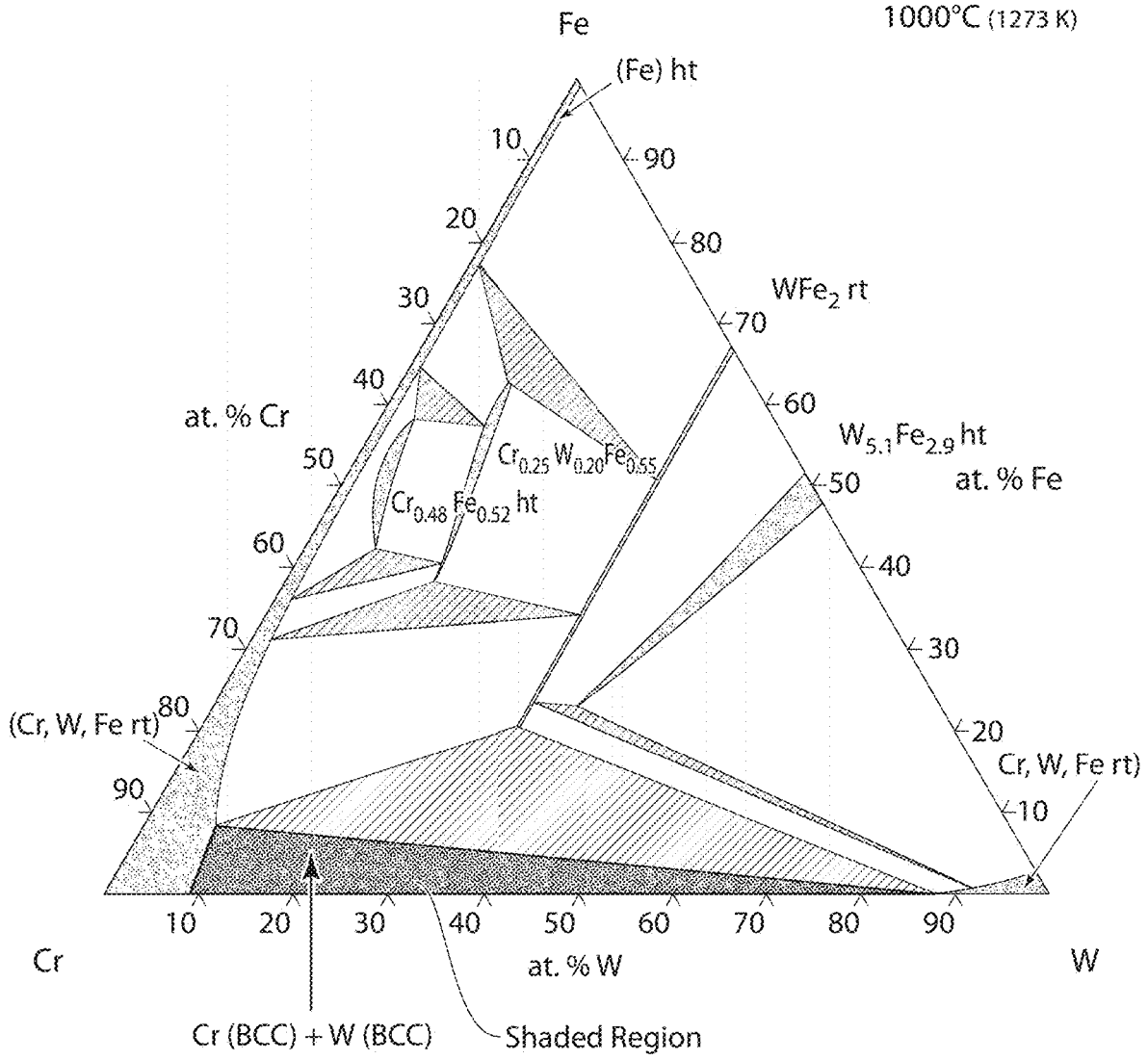
FIG. 5A is the ternary phase diagram of W—Cr—Fe at 1000° C.

In certain embodiments, the first metal material may comprise at least one of tungsten and chromium. In certain embodiments, the first metal material comprises tungsten. In some embodiments, the first metal material comprises chromium. In some cases, the first metal material comprises tungsten (W) and the second metal material comprises chromium (Cr). According to certain embodiments, the second metal material comprises at least one of Pd, Pt, Ni, Co, Fe, Ti, V, Cr, and Sc. Non-limiting examples of nanocrystalline alloys, including those comprising tungsten and/or chromium, are described in more detail in commonly-owned U.S. Patent Publication Number 2014/0271325, entitled "Sintered Nanocrystalline Alloys," which is incorporated herein by reference in its entirety. In some cases, the nanocrystalline alloy comprises a first metal element, a second metal element, and a third metal element. In certain embodiments, the nanocrystalline alloy comprises four or more metal elements. In an exemplary embodiment, the nanocrystalline alloy comprises W, Cr, and/or Fe. The ternary phase diagram for W—Cr—Fe at 1000° C., is shown in FIG. 5A.

In some embodiments, the second metal material element may comprise, or be, an activator material, relative to the first metal material. Activator materials are those materials that increase the rate of sintering of a material, relative to sintering rates that are observed in the absence of the activator material but under otherwise identical conditions. Similarly, activator elements (which are a type of activator material) are those elements that increase the rate of sintering of a material, relative to sintering rates that are observed in the absence of the activator element but under otherwise identical conditions. Activator materials (and activator elements) are described in more detail below.

In certain embodiments, the second metal material may comprise, or be, a stabilizer material, relative to the first metal material. Stabilizer materials are those materials that reduce the rate of grain growth of a material, relative to grain growth rates that are observed in the absence of the stabilizer material but under otherwise identical conditions. Similarly, stabilizer elements (which are a type of stabilizer material) are those elements that reduce the rate of grain growth of a material, relative to grain growth rates that are observed in the absence of the stabilizer element but under otherwise identical conditions. Stabilizer materials (and stabilizer elements) are described in more detail below.

In some embodiments, the metal element of the second metal material may be a transition metal. In some embodiments, the second metal material may comprise Cr, Ti, or both. According to certain embodiments, the second metal material may comprise Ni. For example, in some embodiments, the first metal material comprises Cr, and the second metal material comprises Ni. In certain embodiments, the first metal material comprises W, and the second metal material comprises Ni. In some cases, the first metal material comprises W, and the second metal material comprises Cr.

In certain embodiments, the nanocrystalline alloy comprises at least one of tungsten and chromium. In an exemplary embodiment, the nanocrystalline alloy comprising at least one of tungsten and chromium has an average grain size less than or equal to about 100 nm. In another exemplary embodiment, the nanocrystalline alloy comprising at least one of tungsten and chromium does not contain iron (Fe) or contains iron (Fe) in an amount of less than or equal to about 3.8 at %. In yet another exemplary embodiment, the nanocrystalline alloy comprising at least one of W and Cr has grains with an aspect ratio of less than about 2.

According to certain embodiments, the nanocrystalline alloy of the penetrator comprises a solid solution of tungsten and chromium. In some such embodiments, the nanocrystalline alloy also comprises at least a third metal element (e.g., iron (Fe), palladium (Pd), platinum (Pt), nickel (Ni), and/or cobalt (Co)).

In some embodiments, the amount of the first metal material in the nanocrystalline alloy is greater than the total amount of the second metal material in the nanocrystalline alloy, as determined by atomic percentage. According to certain embodiments, the first metal material is the most abundant material within the nanocrystalline alloy, as measured by atomic percentage. For example, in some embodiments, tungsten is the most abundant element—by atomic percentage—within the nanocrystalline alloy. In certain embodiments, chromium is the most abundant element—by atomic percentage—within the nanocrystalline alloy.

In some embodiments, the nanocrystalline alloy contains the first metal material in an amount of greater than or equal to about 40 at %, greater than or equal to about 45 at %, greater than or equal to about 50 at %, greater than or equal to about 55 at %, greater than or equal to about 60 at %, greater than or equal to about 65 at %, greater than or equal to about 70 at %, greater than or equal to about 75 at %, greater than or equal to about 80 at %, greater than or equal to about 85 at %, greater than or equal to about 90 at %, greater than or equal to about 95 at %, or more.

In some embodiments, the nanocrystalline alloy contains the second metal material in an amount of less than or equal to about 40 at % (and, in some embodiments, less than or equal to about 35 at %, less than or equal to about 30 at %, less than or equal to about 25 at %, less than or equal to about 20 at %, less than or equal to about 15 at %, less than or equal to about 10 at %, less than or equal to about 7.5 at %, less than or equal to about 5 at %, less than or equal to about 2.5 at %, less than or equal to about 1 at %, or less). In some embodiments, the nanocrystalline alloy contains the second metal material in an amount of greater than or equal to about 0.1 at %, greater than or equal to about 0.5 at %, greater than or equal to about 1 at %, greater than or equal to about 2.5 at %, greater than or equal to about 5 at %, greater than or equal to about 7.5 at %, greater than or equal to about 10 at %, greater than or equal to about 12.5 at %, greater than or equal to about 15 at %, greater than or equal to about 17.5 at %, greater than or equal to about 20 at %, greater than or equal to about 25 at %, greater than or equal to about 30 at %, or more.

In some embodiments, the first metal material and the second metal material are selected such that the theoretical density of the nanocrystalline alloy comprising the first metal material and the second metal material is at least about 14 g/cm$^3$, at least about 15 g/cm$^3$, at least about 17 g/cm$^3$, or at least about 18 g/cm$^3$. In certain embodiments, the theoretical density of the alloy is less than or equal to about 18.8 g/cm$^3$, less than or equal to about 18 g/cm$^3$, less than or equal to about 17 g/cm$^3$, or less than or equal to about 15 g/cm$^3$. Combinations of the above referenced ranges are also possible (e.g., between about 14 g/cm$^3$ and about 18.8 g/cm$^3$).

In some embodiments, the nanocrystalline alloy of the penetrator (e.g., comprising at least one of W and Cr) does not contain iron, or contains iron in only a relatively small amount. For example, in certain embodiments, the nanocrystalline alloy contains iron in an amount of less than or equal to about 3.8 atomic percent (at %), less than or equal to about 3.5 at %, less than or equal to about 3.2 at %, less than or equal to about 3 at %, less than or equal to about 2.5 at %, less than or equal to about 2 at %, less than or equal to about 1.5 at %, less than or equal to about 1 at %, less than or equal to about 0.5 at %, or less than or equal to about 0.2 at %. In some embodiments, the nanocrystalline alloy does not contain iron. In some embodiments, the nanocrystalline alloy contains iron in an amount of at least about 0.1 at %, at least about 0.2 at %, at least about 0.5 at %, at least about 1 at %, at least about 1.5 at %, at least about 2 at %, at least about 2.5 at %, at least about 3 at %, at least about 3.2 at %, or at least about 3.5 at %. Combinations of the above-referenced ranges are also possible (e.g., between about 0.1 at % and about 3.8 at %, between about 0.1 at % and about 3 at %, between about 0.1 at % and about 1 at %). Other ranges are also possible. Without wishing to be bound by any particular theory, it is believed that, at higher concentrations of Fe, an intermetallic phase may precipitate, which can have a negative effect on the mechanical properties of the nanocrystalline alloy (e.g., causing the alloy to be more brittle as compared to the alloy without Fe).

In certain embodiments, the nanocrystalline alloy contains between 60 at % and 95 at % W and between 5 at % and 40 at % Cr. In some embodiments, the nanocrystalline alloy contains between 60 at % and 95 at % W, between 5 at % and 40 at % Cr, and between 0 at % and 3.8 at % Fe. In some cases, the nanocrystalline alloy may contain between 80 at % and 95 at % W, between 5 at % and 20 at % Cr, and between 0 at % and 3.8 at % Fe. In some embodiments, the nanocrystalline alloy may contain between 60 at % and 85 at % W, between 15 at % and 40 at % Cr, and between 0 at % and 3.8 at % Fe. For example, in some embodiments, the nanocrystalline alloy has a composition as shown in the shaded region in FIG. 5A.

Certain inventive embodiments are directed to methods of assembling munitions. According to some embodiments, the method comprises associating, with a propellant, a penetrator comprising a plurality of sintered nanocrystalline particulates that form a nanocrystalline alloy. Associating the penetrator with the propellant can result in the formation of any of the munitions described elsewhere herein, including those illustrated in FIGS. 1A-1E.

In some embodiments, the penetrator and the propellant can be associated with each other by arranging each of them on or within a housing. For example, in some embodiments, associating the penetrator with the propellant comprises contacting the penetrator with a housing, wherein a cavity of the housing contains the propellant. In certain embodiments, the propellant may be added to the cavity of the housing as part of the associating step. In other cases, the associating step does not include adding the propellant to the cavity of the housing. For example, the housing may be received (e.g., from another entity) with the propellant already added, and after the housing is received, the penetrator may be contacted with the housing.

As noted above, according to certain embodiments, the method of assembling the munition can involve a penetrator comprising a plurality of sintered nanocrystalline particulates that form a nanocrystalline alloy. The nanocrystalline alloy of the penetrator may be made, for example, by sintering the nanocrystalline particulates. In some embodiments, the inventive method can include both the step of sintering the nanocrystalline particulates to form the nanocrystalline alloy used in the penetrator (which sintering process may include any of the sintering method features described elsewhere herein) and the step of associating the penetrator with the propellant. In other embodiments, the inventive methods do not include the step of sintering the nanocrystalline particulates, but rather, include receiving the nanocrystalline alloy comprising the sintered nanocrystalline particulates from another entity that performs the sintering, and associating a penetrator comprising the nanocrystalline alloy (as-received from the other entity, or after one or more additional processing steps performed after receipt from the other entity) with the propellant. Thus, it should be understood that, for each of the method features described below and elsewhere herein, such features may be performed by the same entity that associates the penetrator with the propellant, or by an entity other than the entity that associates the penetrator with the propellant.

In some embodiments, the nanocrystalline alloy of the penetrator is formed by sintering a plurality of nanocrystalline particulates. The penetrator comprising the plurality of sintered nanocrystalline particulates may have any of the penetrator properties described elsewhere herein.

Nanocrystalline materials may be susceptible to grain growth. The susceptibility can, in certain cases, make it difficult to produce bulk nanocrystalline materials with high relative densities and small grain sizes utilizing traditional sintering techniques. Additionally, the susceptibility may limit the ability of sintered nanocrystalline materials to be subjected to post-sintering processing techniques without experiencing undesired grain growth. Certain embodiments described herein take advantage of methods of performing sintering such that undesired grain growth does not occur during the sintering process.

According to certain embodiments, the nanocrystalline particulates include a first metal material (such as tungsten or chromium) and a second metal material. The second metal material may be, for example, an activator material (e.g., an activator element) or a stabilizer material (e.g., a stabilizer element). Combinations of these are also possible. Activator materials and stabilizer materials are described in more detail below.

In some embodiments, the total amount of the first metal material in the nanocrystalline particulates is greater than the total amount of the second metal material in the nanocrystalline particulates, as determined using atomic percentages. According to certain embodiments, the first metal material is the most abundant material within the nanocrystalline particulates, as determined by atomic percentage. For example, in some embodiments, tungsten is the most abundant element—by atomic percentage—within the nanocrystalline particulates. In certain embodiments, chromium is the most abundant element—by atomic percentage—within the nanocrystalline particulates.

In some embodiments, at least some of the nanocrystalline particulates contain the first metal material in an amount of greater than or equal to about 40 at %, greater than or equal to about 45 at %, greater than or equal to about 50 at %, greater than or equal to about 55 at %, greater than or equal to about 60 at %, greater than or equal to about 65 at %, greater than or equal to about 70 at %, greater than or equal to about 75 at %, greater than or equal to about 80 at %, greater than or equal to about 85 at %, greater than or equal to about 90 at %, greater than or equal to about 95 at %, or more. In some embodiments, the total amount of the first metal material in the nanocrystalline particulates is greater than or equal to about 40 at %, greater than or equal to about 45 at %, greater than or equal to about 50 at %, greater than or equal to about 55 at %, greater than or equal to about 60 at %, greater than or equal to about 65 at %, greater than or equal to about 70 at %, greater than or equal to about 75 at %, greater than or equal to about 80 at %, greater than or equal to about 85 at %, greater than or equal to about 90 at %, greater than or equal to about 95 at %, or more.

In some embodiments, at least some of the nanocrystalline particulates contain the second metal material in an amount of less than or equal to about 40 at % (and, in some embodiments, less than or equal to about 35 at %, less than or equal to about 30 at %, less than or equal to about 25 at %, less than or equal to about 20 at %, less than or equal to about 15 at %, less than or equal to about 10 at %, less than or equal to about 7.5 at %, less than or equal to about 5 at %, less than or equal to about 2.5 at %, less than or equal to about 1 at %, or less). In some embodiments, at least some of the nanocrystalline particulates contain the second metal material in an amount of greater than or equal to about 0.1 at %, greater than or equal to about 0.5 at %, greater than or equal to about 1 at %, greater than or equal to about 2.5 at %, greater than or equal to about 5 at %, greater than or equal to about 7.5 at %, greater than or equal to about 10 at %, greater than or equal to about 12.5 at %, greater than or equal to about 15 at %, greater than or equal to about 17.5 at %, greater than or equal to about 20 at %, greater than or equal to about 25 at %, greater than or equal to about 30 at %, or more.

In some embodiments, the total amount of the second metal material in the nanocrystalline particulates is less than or equal to about 40 at % (and, in some embodiments, less than or equal to about 35 at %, less than or equal to about 30 at %, less than or equal to about 25 at %, less than or equal to about 20 at %, less than or equal to about 15 at %, less than or equal to about 10 at %, less than or equal to about 7.5 at %, less than or equal to about 5 at %, less than or equal to about 2.5 at %, less than or equal to about 1 at %, or less). In some embodiments, the total amount of the second metal material in the nanocrystalline particulates is greater than or equal to about 0.1 at %, greater than or equal to about 0.5 at %, greater than or equal to about 1 at %, greater than or equal to about 2.5 at %, greater than or equal to about 5 at %, greater than or equal to about 7.5 at %, greater than or equal to about 10 at %, greater than or equal to about 12.5 at %, greater than or equal to about 15 at %, greater than or equal to about 17.5 at %, greater than or equal to about 20 at %, greater than or equal to about 25 at %, greater than or equal to about 30 at %, or more.

In some embodiments, the first metal material and the second metal material are selected such that the theoretical density of the nanocrystalline particulates comprising the first metal material and the second metal material is at least about 14 g/cm$^3$, at least about 15 g/cm$^3$, at least about 17 g/cm$^3$, or at least about 18 g/cm$^3$. In certain embodiments, the theoretical density of the alloy is less than or equal to about 18.8 g/cm$^3$, less than or equal to about 18 g/cm$^3$, less than or equal to about 17 g/cm$^3$, or less than or equal to about 15 g/cm$^3$. Combinations of the above referenced ranges are also possible (e.g., between about 14 g/cm$^3$ and about 18.8 g/cm$^3$).

In some embodiments, the nanocrystalline particulates include at least some grains with a size of less than or equal to about 100 nm. In some embodiments, the nanocrystalline particulates contain at least some grains with a size of less than or equal to about 90 nm, less than or equal to about 80 nm, less than or equal to about 70 nm, less than or equal to about 60 nm, less than or equal to about 50 nm, less than or equal to about 40 nm, less than or equal to about 30 nm, less than or equal to about 20 nm, less than or equal to about 10 nm, less than or equal to about 5 nm, less than or equal to about 2 nm, or smaller. In some embodiments, the nanocrystalline particulates comprise polycrystalline particulates (i.e., containing a plurality of grains).

According to certain embodiments, at least some of the nanocrystalline particulates are formed by mechanically working a powder comprising the first metal material and the second metal material. For example, certain embodiments comprise making nanocrystalline tungsten particulates, at least in part, by mechanically working a powder including a plurality of tungsten particulates and a second metal material. Certain embodiments comprise making nanocrystalline chromium particulates, at least in part, by mechanically working a powder including a plurality of chromium particulates and a second metal material. In some embodiments, the second metal material may be an activator element or a stabilizer element.

Any appropriate method of mechanical working may be employed to mechanically work a powder and form nanocrystalline particulates. According to certain embodiments, at least some of the nanocrystalline particulates are formed by ball milling a powder comprising the first metal material and the second metal material. The ball-milling process may be, for example, a high energy ball milling process. In a non-limiting exemplary ball milling process, a tungsten carbide or steel milling vial may be employed, with a ball-to-powder ratio of about 2:1 to about 5:1, and a stearic acid process control agent content of about 0.01 wt % to about 3 wt %. In some embodiments, the mechanical working may be carried out in the presence of a stearic acid process control agent content of about 1 wt %, about 2 wt %, or about 3 wt %. According to certain other embodiments, the mechanical working is carried out in the absence of a process control agent. Other types of mechanical working may also be employed, including but not limited to, shaker milling and planetary milling. In some embodiments, the mechanical working (e.g., via ball milling or another process) may be performed under conditions sufficient to produce a nanocrystalline particulate comprising a supersaturated phase. Supersaturated phases are described in more detail below.

In certain embodiments, the mechanical working (e.g., ball milling) may be conducted for a time of greater than or equal to about 2 hours (e.g., greater than or equal to about 4 hours, about 6 hours, about 8 hours, about 10 hours, about 12 hours, about 15 hours, about 20 hours, about 25 hours, about 30 hours, or about 35 hours). In some embodiments, the mechanical working (e.g., ball milling) may be conducted for a time of about 1 hour to about 35 hours (e.g., about 2 hours to about 30 hours, about 4 hours to about 25 hours, about 6 hours to about 20 hours, about 8 hours to about 15 hours, or about 10 hours to about 12 hours). In some cases, if the mechanical working time is too long, the first material (e.g., tungsten powder) may be contaminated by the material used to perform the mechanical working (e.g., milling vial material). The amount of the second metal material that is dissolved in the first metal material (e.g., a tungsten material) may, in some cases, increase with increasing mechanical working (e.g., milling) time. In some embodiments, after the mechanical working step (e.g., ball milling step), a phase rich in the second metal material may be present.

The nanocrystalline particulates may, according to certain embodiments, include a non-equilibrium phase in which the second metal material is dissolved in the first metal material. According to some embodiments, the non-equilibrium phase may be a supersaturated phase. A "supersaturated phase," as used herein, refers to a phase in which a material is dissolved in another material in an amount that exceeds the solubility limit. The supersaturated phase can include, in some embodiments, an activator element and/or a stabilizer element forcibly dissolved in the first metal material in an amount that exceeds the amount of the activator element and/or the stabilizer element that could be otherwise dissolved in an equilibrium phase of the first metal material. For example, in one set of embodiments, the supersaturated phase is a phase that includes an activator element forcibly dissolved in tungsten in an amount that exceeds the amount of activator element that could be otherwise dissolved in an equilibrium tungsten phase.

In some embodiments, the supersaturated phase may be the only phase present after the mechanical working (e.g., ball milling) process. In certain embodiments, a second phase rich in the second metal material may be present after the mechanical working (e.g., ball milling) process. For example, in some cases, a second phase rich in the activator element may be present after mechanical working (e.g., ball milling).

According to certain embodiments, the non-equilibrium phase may undergo decomposition during the sintering of the nanocrystalline particulates. The sintering of the nanocrystalline particulates may cause the formation of a phase rich in the second metal material at at least one of the surface and grain boundaries of the nanocrystalline particulates. In some such embodiments, the first metal material is soluble in the phase rich in the second metal material. The formation of the phase rich in the second metal material may be the result of the decomposition of the non-equilibrium phase during the sintering. The phase rich in the second metal material may, according to certain embodiments, act as a fast diffusion path for the first metal material, enhancing the sintering kinetics and accelerating the rate of sintering of the nanocrystalline particulates. According to some embodiments, the decomposition of the non-equilibrium phase during the sintering of the nanocrystalline particulates accelerates the rate of sintering of the nanocrystalline particulates. The nanocrystalline alloy produced as a result of the sintering process may be a bulk nanocrystalline alloy.

In some embodiments, the second metal material may have a lower melting temperature than the first metal material. In another embodiment, the first metal material may be soluble in the second metal material. In some embodiments, the solubility of the first metal material in the second metal material may increase with increasing temperature. In certain embodiments, the diffusivity of the first metal material in a phase rich in the second metal material is greater than the diffusivity of the first metal material in itself.

In some embodiments, the nanocrystalline alloy may have at least some grains having a grain size of less than or equal to about 100 nm, as described above. In some embodiments, the nanocrystalline alloy may have a relatively small cross-sectional average grain size, including a cross-sectional average grain size falling within any of the ranges described elsewhere herein. In some embodiments, for at least one cross-section of the nanocrystalline alloy, the cross-sectional average grain size of the sintered nanocrystalline alloy may be smaller than the corresponding cross-sectional average grain size of a sintered material that includes the first metal material in the absence of the second metal material. In some embodiments, for at least one cross-section of the nanocrystalline alloy, the cross-sectional average grain size of the sintered nanocrystalline alloy may be about the same as the corresponding cross-sectional average grain size of a sintered material that includes the first metal material in the absence of the second metal material. In some embodiments, for at least one cross-section of the nanocrystalline alloy, the cross-sectional average grain size of the sintered nanocrystalline alloy may be less than or the same as the corresponding cross-sectional average grain size of a sintered material that includes the first metal material in the absence of the second metal material. To compare the cross-sectional average grain size of a cross-section of a sintered nanocrystalline alloy to the corresponding cross-sectional average grain size of a sintered material that includes the first metal material in the absence of the second metal material, one would prepare the sintered material using identical methods and materials as were used for the sintered nanocrystalline alloy but without the second metal material. A cross-section of the sintered nanocrystalline alloy and a spatially corresponding cross-section of the sintered material would then be taken, and the cross-sectional average grain size of each cross-section would be determined.

As noted above, in some embodiments, additive alloying elements may be employed. In some such embodiments, the additive alloying element corresponds to the second metal material. In some embodiments, the nanocrystalline alloy is alloyed with a third metal material. In some such embodiments, the additive alloying element corresponds to the third metal material.

In some embodiments, the additive alloying element is a stabilizer element. In certain embodiments, the additive alloying element is an activator element. Stabilizer and activator elements may be employed separately or in combination.

In some embodiments, the additive element(s) may be at least one of Pd, Pt, Ni, Co and Fe.

The activator element may enhance the sintering kinetics of the first metal material (e.g., tungsten and/or chromium). According to certain embodiments, the activator element may provide a high diffusion path for the atoms of the first metal material (e.g., tungsten and/or chromium atoms). For example, in some embodiments, the additive metal element may surround the first metal material (e.g., tungsten or chromium particles) and provide a relatively high transport diffusion path for the first metal material (e.g., tungsten or chromium), thereby reducing the activation energy of diffusion of the first metal material (e.g., tungsten or chromium). In some embodiments, this technique is referred to as activated sintering.

As a result, the sintering temperature in some embodiments may be less than or equal to about 1500° C. (e.g., less than or equal to about 1450° C., about 1400° C., about 1350° C., about 1300° C., about 1250° C., about 1200° C., about 1150° C., about 1100° C., about 1050° C., or lower). In some embodiments, the sintering temperature may be about 1000° C. The reduction of the sintering temperature may allow sintering to take place in the temperature range where the nanostructure of the nanocrystalline first metal material (e.g., tungsten and/or chromium) is stable against grain growth. In some embodiments, the sintering temperature may be affected by the heating rate employed.

The activator element may, in some embodiments, lower the temperature required to sinter the nanocrystalline particulates, relative to the temperature that would be required to sinter the nanocrystalline particulates in the absence of the activator element but under otherwise identical conditions. Thus, the sintering may involve, according to certain embodiments, a first sintering temperature, and the first sintering temperature may be lower than a second sintering temperature needed for sintering the first metal material in the absence of the second metal material. To determine the sintering temperature needed for sintering the first metal material in the absence of the second metal material, one would prepare a sample of the first metal material that does not contain the second metal material but is otherwise identical to the nanocrystalline particulate material. One would then determine the minimum temperature needed to sinter the sample that does not include the second metal material.

The activator element may be any element capable of enhancing the sintering kinetics of the sintered material. In some embodiments of activated sintering, the activator element may act as a fast carrier path for the diffusion of the first metal material (e.g., tungsten and/or chromium). As a result, in some embodiments the selection of an activator element may be based on two conditions. First, the activator element should, according to certain embodiments, exhibit relatively high solubility for the first metal material (e.g., tungsten and/or chromium), allowing the activator element to act as a fast diffusion path for tungsten and/or chromium atoms. Second, according to certain embodiments, the diffusion rate of the first metal material (e.g., tungsten and/or chromium) in a phase rich in an activator element may be relatively high. Additionally, the diffusion rate of the first metal material (e.g., tungsten and/or chromium) in an activator element rich phase should, according to certain embodiments, be higher than the diffusion rate of the first metal material (e.g., tungsten and/or chromium) in itself. The term "rich" with respect to the content of an element in a phase generally refers to a content of the element in the phase of at least about 50 at %—e.g., at least about 60 at %, about 70 at %, about 80 at %, about 90 at %, about 99 at %, or higher. The term "phase" is generally used to refer to a state of matter. For example, in some embodiments a phase may refer to a phase shown on a phase diagram.

In some embodiments, the first metal material (e.g., tungsten and/or chromium) is soluble in the activator element. In some embodiments, the solubility of the first metal material (e.g., tungsten and/or chromium) in the activator element increases with increasing temperature. In some embodiments, the melting temperature of the activator element may be less than the melting temperature of the first metal material (e.g., tungsten and/or chromium).

According to certain embodiments, the amount of an activator may be minimized so that the quantity available for interaction with the stabilizer element is reduced. In some embodiments, the activator element may be present in an amount greater than or equal to about 0.15 at %—e.g., greater than or equal to or about 0.3 at %, about 0.5 at %, about 1 at %, about 3 at %, about 5 at %, about 8 at %, about 10 at %, about 13 at %, about 15 at %, about 18 at %, about 20 at %, about 23 at %, about 25 at %, about 30 at %, about 35 at %, about 40 at %, about 45 at %, or greater. In some embodiments, the activator element may be present in an amount of about 0.15 at % to about 45 at %—e.g., about 0.3 at % to about 40 at %, about 0.5 at % to about 35 at %, about 1 at % to about 30 at %, about 3 at % to about 25 at %, about 5 at % to about 23 at %, about 8 at % to about 20 at %, about 10 at % to about 18 at %, or about 13 at % to about 15 at %, etc. In some embodiments, the activator element may be present in an amount of about 0.15 at %, about 0.3 at %, about 0.5 at %, about 1 at %, about 3 at %, about 5 at %, about 8 at %, about 10 at %, about 13 at %, about 15 at %, about 18 at %, about 20 at %, about 23 at %, about 25 at %, about 30 at %, about 35 at %, about 40 at %, or about 45 at %.

In some embodiments, the activator element may be a metal element, which may be any of the aforedescribed metal elements. In some embodiments the activator element may be at least one of Pd, Pt, Ni, Co, and Fe.

The stabilizer element may be any element capable of reducing the amount of grain growth that occurs, relative to the amount that would occur in the absence of the stabilizer element but under otherwise identical conditions. In some embodiments, the stabilizer element reduces grain growth by reducing the grain boundary energy of the sintered material, and/or by reducing the driving force for grain growth. The stabilizer element may, according to certain embodiments, exhibit a positive heat of mixing with the sintered material. In some embodiments, the stabilizer element may be a metal element, which may be any of the aforedescribed metal elements.

The stabilizer element may stabilize nanocrystalline tungsten and/or chromium by segregation in the grain boundaries. This segregation may reduce the grain boundary energy, and/or may reduce the driving force against grain growth in the alloy, as described above.

The stabilizer element may be present in an amount of greater than or equal to about 2.5 at %—e.g., greater than or equal to about 5 at %, about 7.5 at %, about 10 at %, about 12.5 at %, about 15 at %, about 17.5 at %, about 20 at %, about 25 at %, about 30 at %, about 35 at %, about 40 at %, about 45 at %, or greater. In some embodiments, the stabilizer element may be present in an amount of from about 2.5 at % to about 45 at %—e.g., about 5 at % to about 40 at %, about 7.5 at % to about 35 at %, about 10 at % to about 30 at %, about 12.5 at % to about 25 at %, or about 15 at % to about 20 at %, etc. In some embodiments, the stabilizer element may be present in an amount of about 2.5 at %, about 5 at %, about 7.5 at %, about 10 at %, about 12.5 at %, about 15 at %, about 17.5 at %, about 20 at %, about 25 at %, about 30 at %, about 35 at %, about 40 at %, or about 45 at %.

In another embodiment, the stabilizer element may also be the activator element. The use of a single element both as the stabilizer and activator elements has the added benefit, according to certain embodiments, of removing the need to consider the interaction between the activator and the stabilizer. In some embodiments, the element that may be utilized as both the activator and stabilizer element may be a metal element, which may be any of the aforedescribed metal elements. In some embodiments at least one of Ti, V, Cr, and Sc, or combinations thereof, may be utilized as both the activator and stabilizer element. In certain embodiments Cr, Ti, or both may be utilized as both the activator and stabilizer element.

Figure 2A:
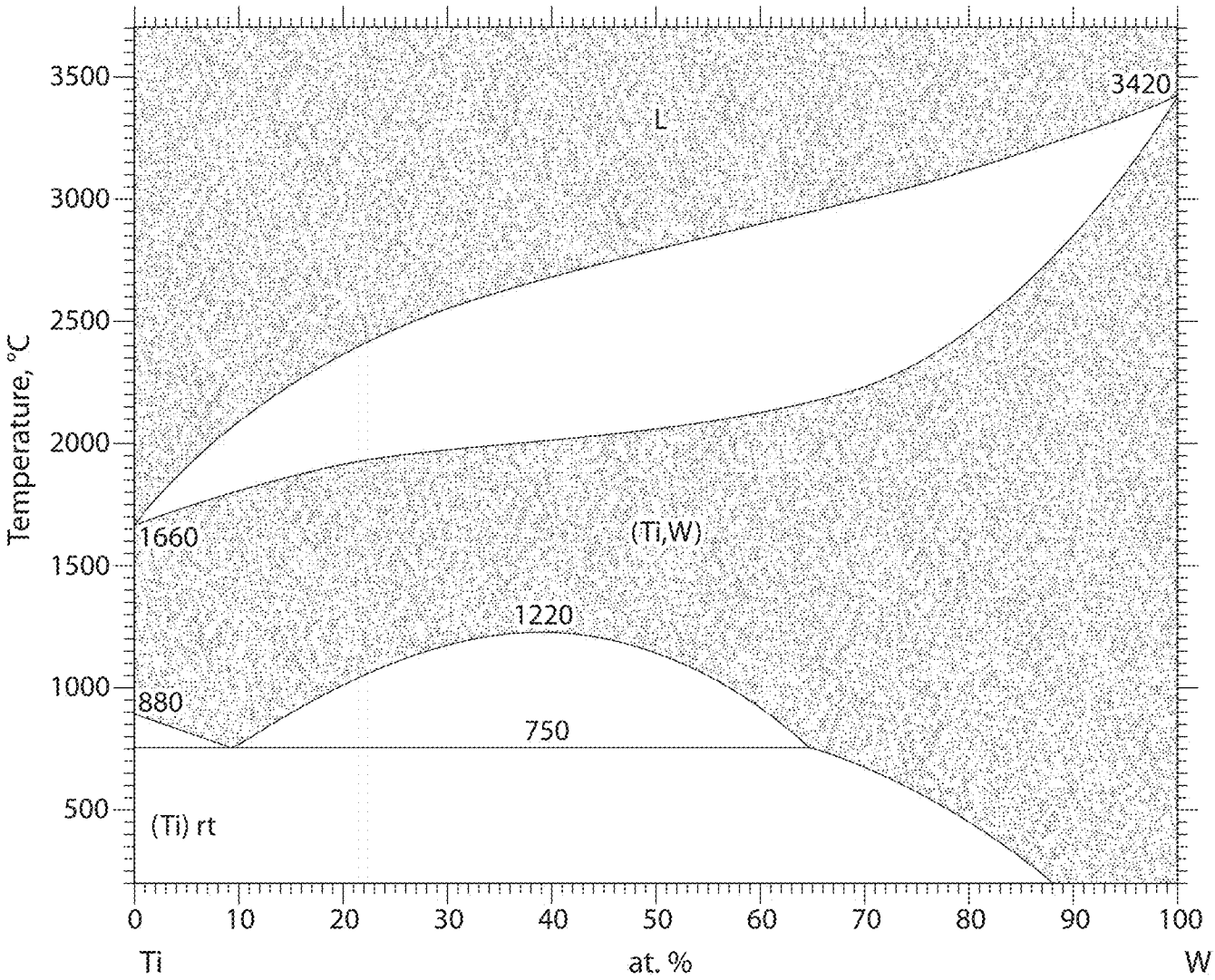
FIG. 2A is the phase diagram of Ti—W.
Figure 2B:
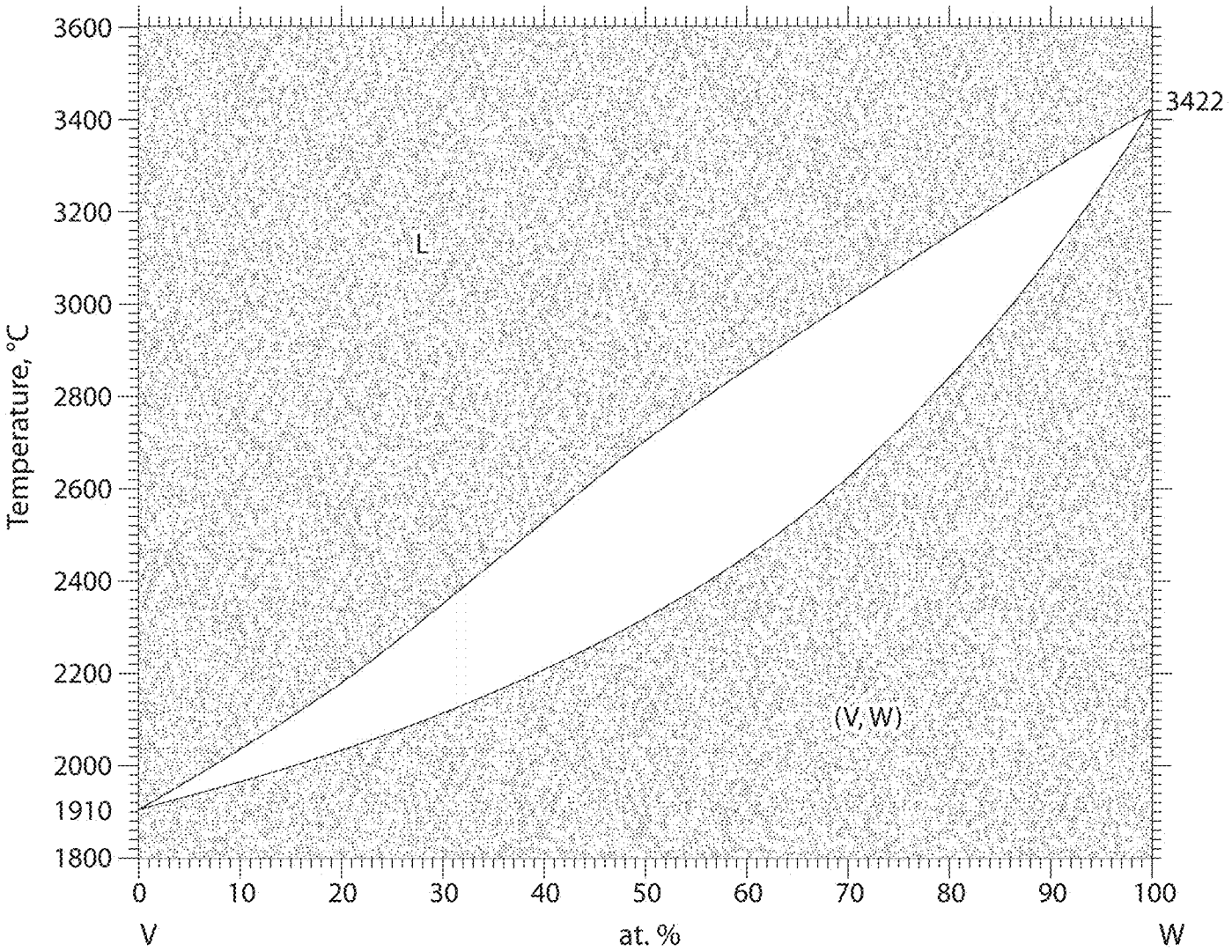
FIG. 2B is the phase diagram of V-W.
Figure 3A:
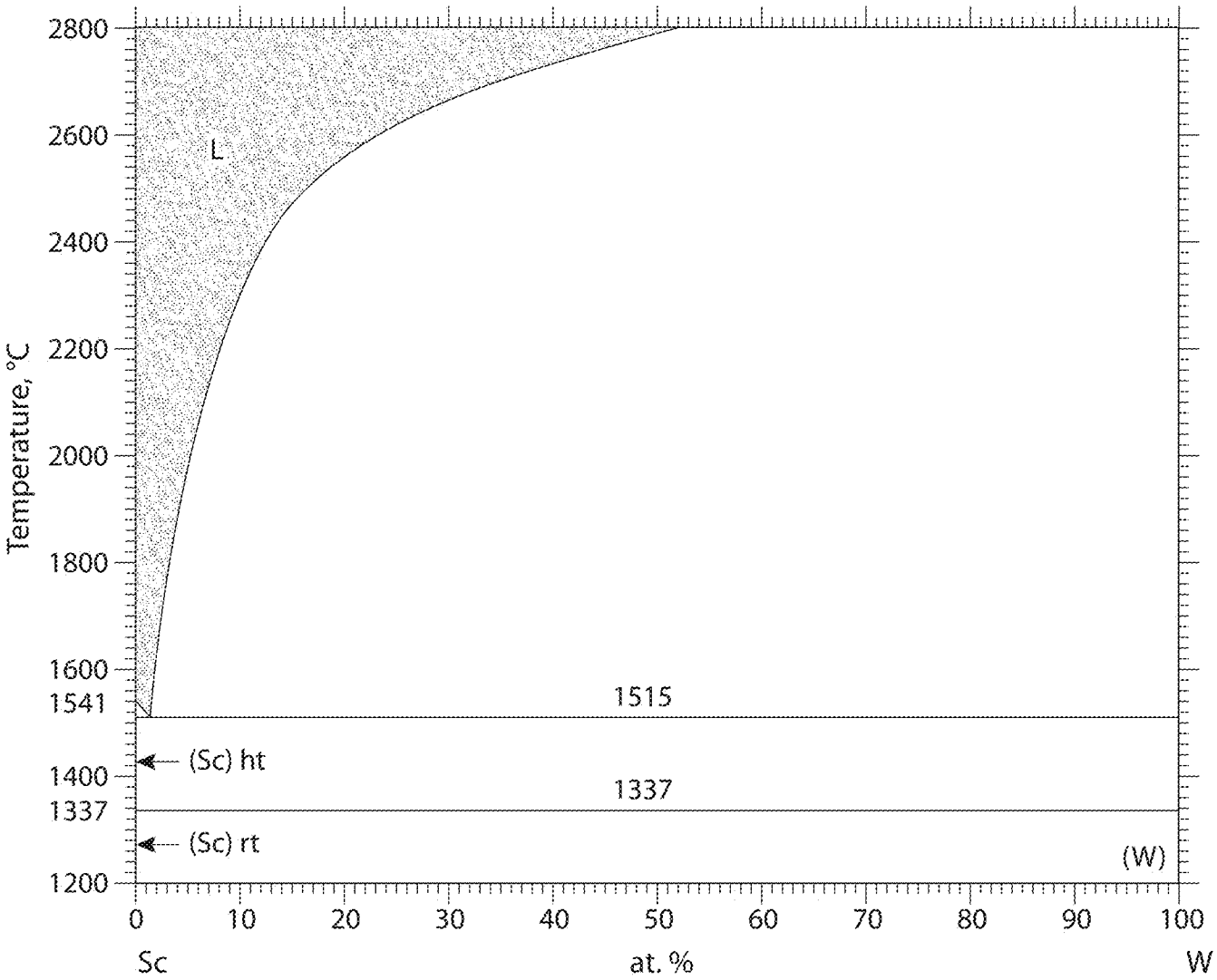
FIG. 3A is the phase diagram of Sc—W.
Figure 3B:
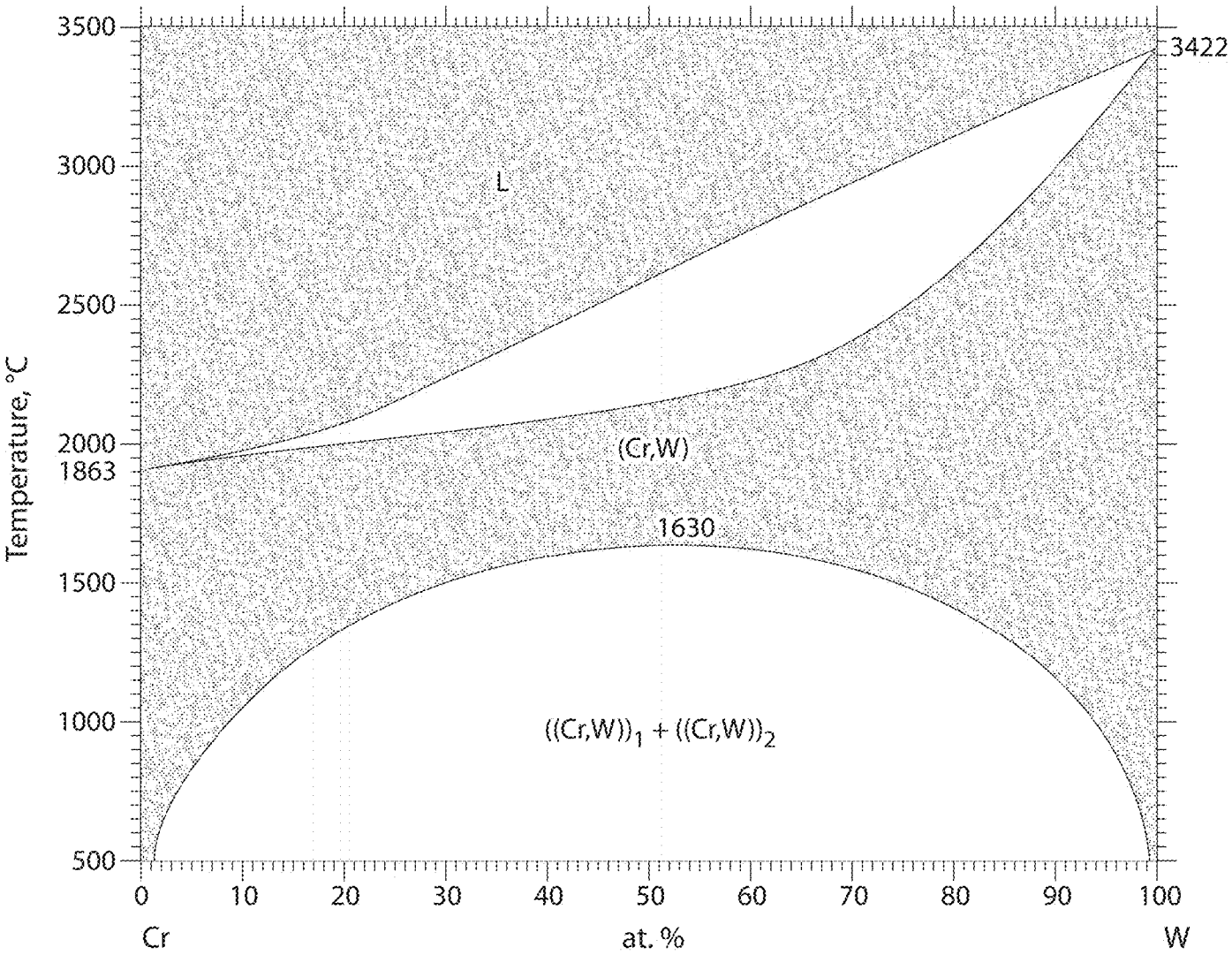
FIG. 3B is the phase diagram of Cr—W.

For example, in the case of both Ti and V, a solid solution may be formed in some cases with tungsten at the sintering temperature (below 1500° C.), as shown in the phase diagrams in FIGS. 2A-2B. In the case of Sc, in certain embodiments, the Sc and W phases exist separately at the expected sintering temperature (below 1500° C.), as shown in the phase diagram in FIG. 3A. Thus, in some embodiments the Sc may be able to provide a diffusion path for the tungsten. In the case of Cr, in some embodiments, the Cr rich and W rich phases exist separately at the expected sintering temperature (e.g., below 1500° C.), as shown in the phase diagram in FIG. 3B. In addition, Cr has a relatively high segregation enthalpy compared to other stabilizers, and the diffusivity of tungsten in Cr is higher than the self-diffusivity of tungsten. In some embodiments Cr may act as both the activator element and the stabilizer element, producing a W—Cr nanocrystalline alloy.

According to certain embodiments, when one element cannot act as both the stabilizer and the activator, two elements may be employed. The interaction between the two elements may be accounted for, according to some embodiments, to ensure that the activator and stabilizer roles are properly fulfilled. For example, when the activator and the stabilizer form an intermetallic compound each of the elements may be prevented from fulfilling their designated role, in some cases. As a result, activator and stabilizer combinations with the ability to form intermetallic compounds at the expected sintering temperatures should be avoided, at least in some instances. The potential for the formation of intermetallic compounds between two elements may be analyzed with phase diagrams.

Figure 4A:
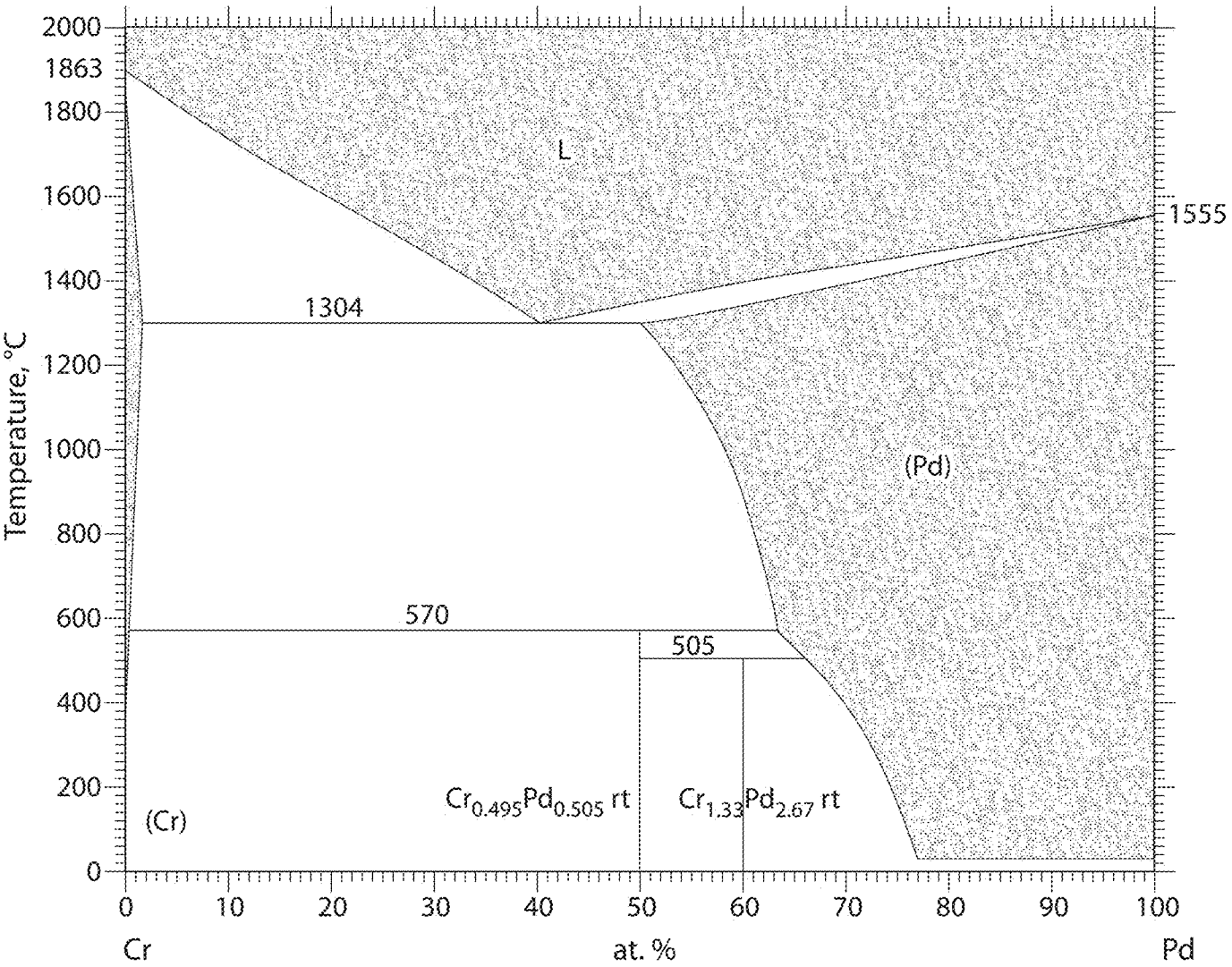
FIG. 4A is the phase diagram of Cr—Pd.

FIG. 4A illustrates some embodiments, wherein Cr and Pd in an amount of 20 at % Cr and 0.7 at % Pd (corresponding to 0.5 wt % Pd compared to tungsten) are added. As shown in FIG. 4A, a Cr phase and a Pd phase coexist above 570° C., and a Cr phase and a liquid phase coexist above 1304° C. Although a ternary diagram may be important in determining whether an intermetallic compound may be formed, the binary phase diagrams indicate that separate Cr and Pd phases may coexist. In some embodiments, the sintering temperature may be below 1300° C., and Cr and the Pd exist in this temperature range as separate phases based on the binary phase diagrams, allowing Cr and Pd to fulfill the roles of a stabilizer and activator, respectively, without interference from each other. In another embodiment, the processing temperature may be above 1300° C., and a liquid sintering technique may be employed.

Figure 4B:
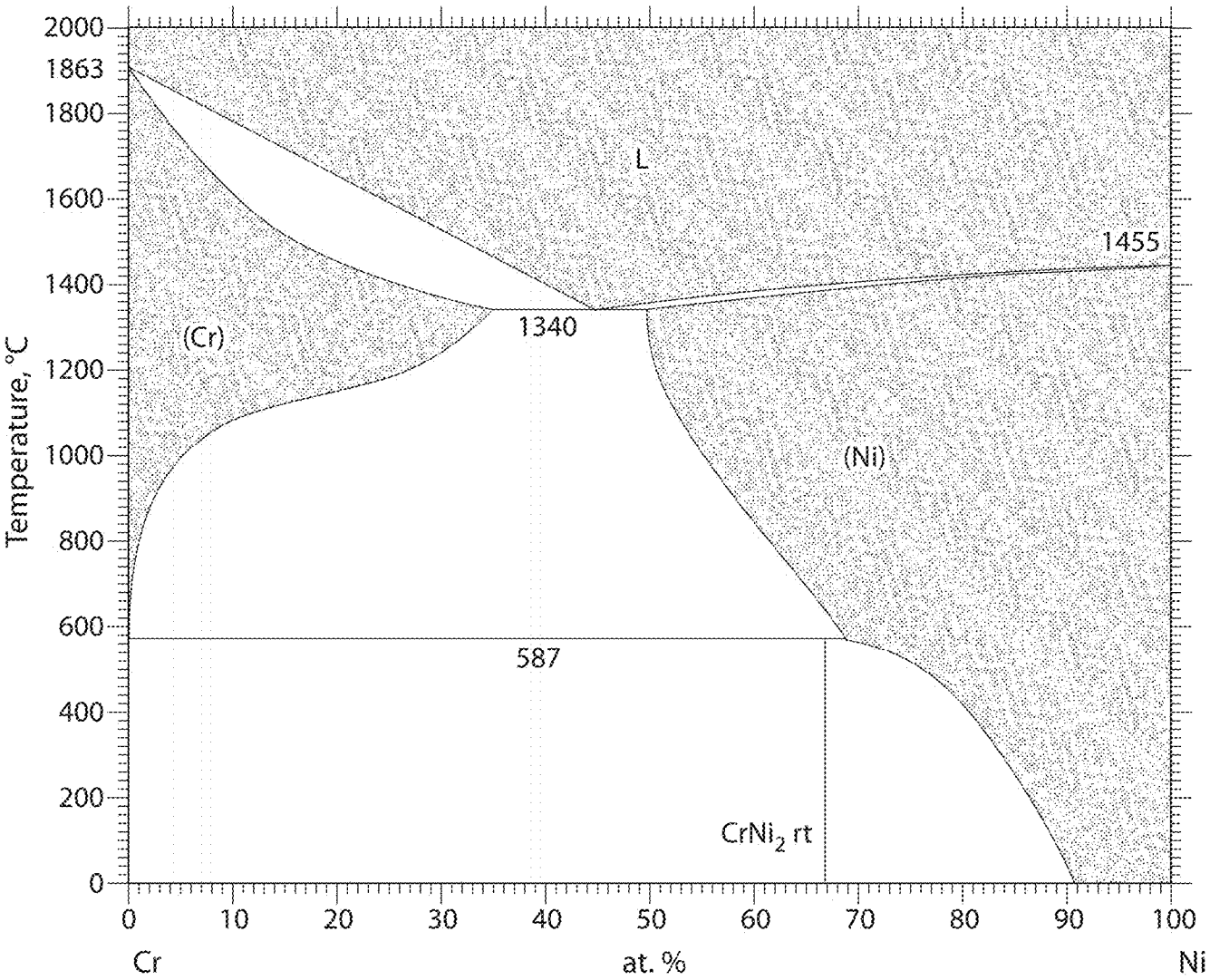
FIG. 4B is the phase diagram of Cr—Ni.

FIG. 4B illustrates some embodiments, wherein Cr and Ni in an amount of 20 at % Cr and 1.3 at % Ni (corresponding to 0.5 wt % Ni compared to tungsten) are added. A Cr phase and a Ni phase coexist above 587° C., and only the Cr phase exists above 1000° C.

Figure 5B:
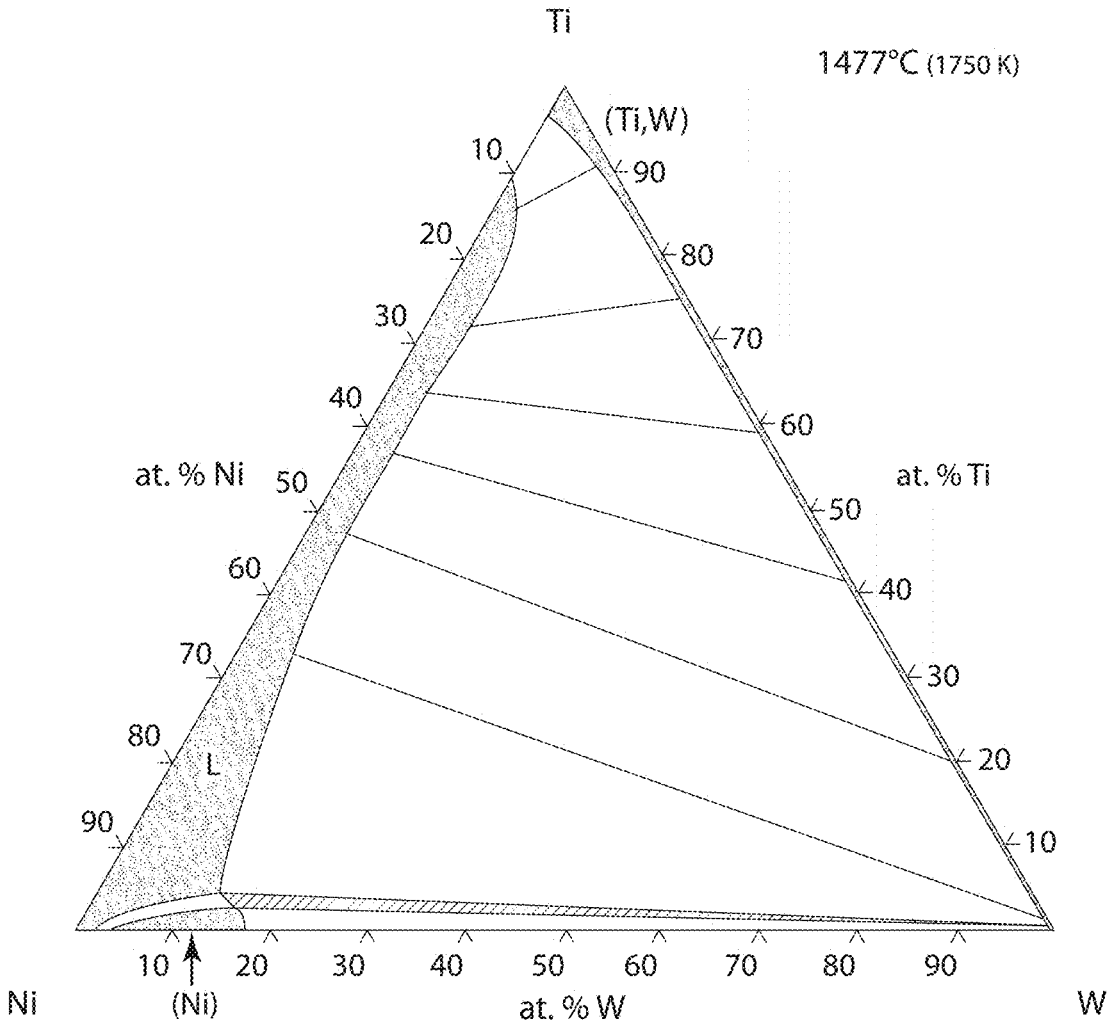
FIG. 5B is the ternary phase diagram of W—Ti—Ni at 1477° C.

The ternary phase diagram for W—Ti—Ni, as shown in FIG. 5B for 1477° C., indicates that a liquid phase exists at the composition, W—20 at % Ti—1.3 at % Ni. In some embodiments, a liquid phase sintering technique may be employed for W—Ti—Ni, which may further enhance sintering kinetics like activated sintering.

According to certain embodiments, liquid phase sintering is employed. In at least some embodiments of liquid phase sintering, the alloy contains more than one component above the solidus line of the components at the expected processing temperature, and a liquid phase is present at the expected processing temperature. The densification rate may be faster for liquid phase sintering, compared to solid state sintering, due to the high diffusivity of atoms in the liquid phase. Industrial sintering may generally be performed in the presence of a liquid phase due to cost and productivity advantages. Over 70% of sintered materials may be processed using liquid phase sintering techniques.

Figure 5C:
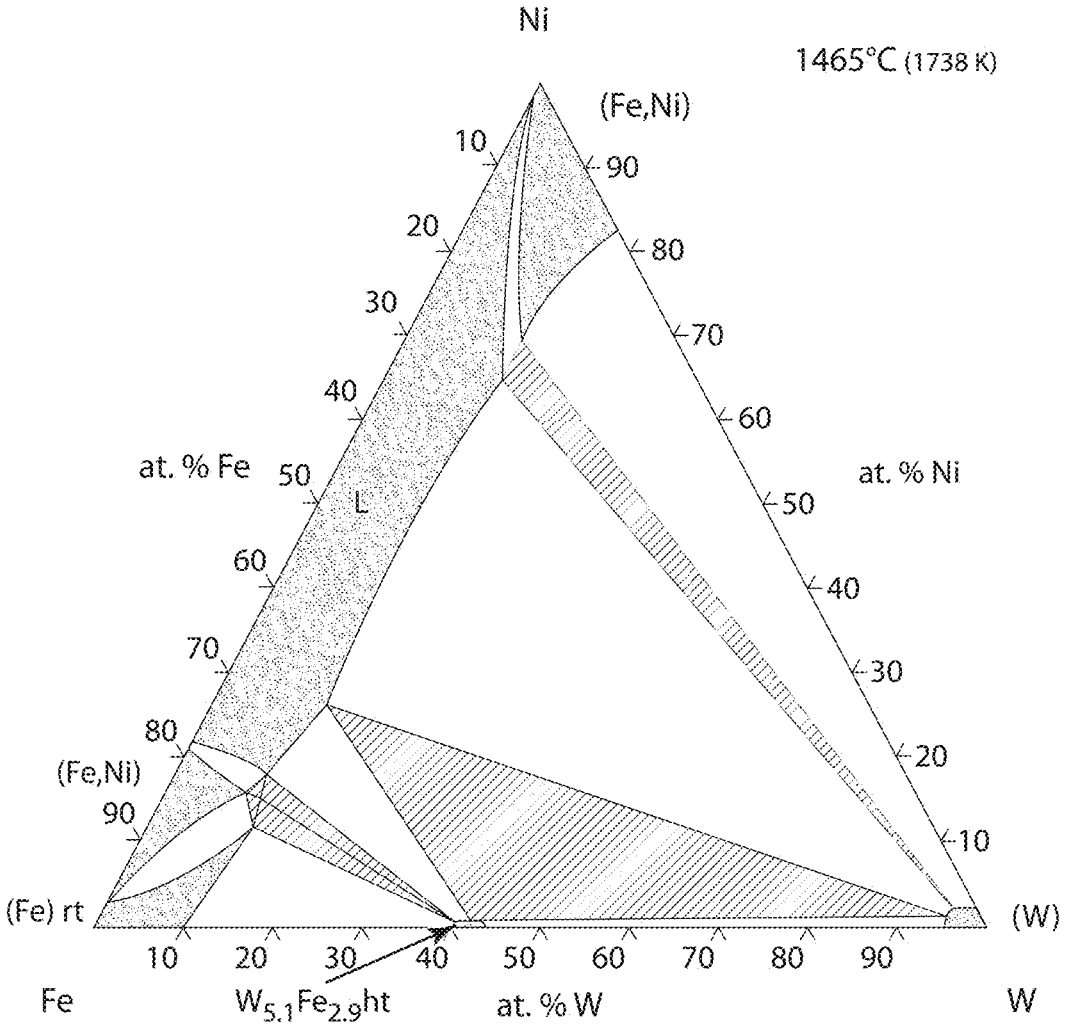
FIG. 5C is the ternary phase diagram of W—Ni—Fe at 1465° C.

In some embodiments a W—Ni—Fe alloy system may be sintered by liquid phase sintering techniques. A temperature above 1460° C. may be applied for liquid phase sintering of 98 wt % W—1 wt % Ni—1 wt % Fe. A liquid phase may emerge at this concentration combination of Ni and Fe, as shown in FIG. 5C. The low solubility of Ni and Fe in tungsten may aid tungsten powder sintering. This system may be similar to the W—Ni—Ti alloy system.

In some embodiments, the sintering mechanism described herein may be useful for the production of ultra-fine and nanocrystalline sintered materials due to the ability of second phases and alloying elements to maintain ultra-fine and nanocrystalline structures during heat treatment.

The sintering conditions for the production of the sintered material may be any appropriate conditions. According to some embodiments, a high sintering temperature may be employed for a short sintering time to produce the sintered material. Alternatively, a comparably lower sintering temperature may be employed for a longer sintering time to produce a sintered material that is densified to the same or substantially the same degree. In some embodiments, extended sintering times may result in an undesired increase in grain size.

According to certain embodiments, the sintering may be a pressureless or a substantially pressureless sintering process. The sintering mechanism described herein allows, according to certain embodiments, for the production of relatively highly dense sintered ultra-fine and nanocrystalline materials even in the absence or substantial absence of external pressure applied during the sintering process. In some embodiments, for at least about 20%, at least about 50%, at least about 75%, at least about 90%, or at least about 98% of the time during which sintering is performed, the maximum external pressure applied to the nanocrystalline particulates is less than or equal to about 2 MPa, less than or equal to about 1 MPa, less than or equal to about 0.5 MPa, or less than or equal to about 0.1 MPa. The maximum external pressure applied to the nanocrystalline particulates refers to the maximum pressure applied as a result of the application of a force external to the nanocrystalline particulates, and excludes the pressure caused by gravity and arising between the nanocrystalline particulates and the surface on which the nanoparticulates are positioned during the sintering process.

U.S. Patent Publication Number 2014/0271325, entitled "Sintered Nanocrystalline Alloys," published on Sep. 18, 2014, and filed on Mar. 14, 2014 as U.S. patent application Ser. No. 14/214,282 is incorporated herein by reference in its entirety for all purposes. International Patent Publication No. WO 2014/152838, entitled "Sintered Nanocrystalline Alloys," published on Sep. 25, 2014, and filed on Mar. 14, 2014 as International Patent Application Serial No. PCT/US14/27932 is also incorporated herein by reference in its entirety for all purposes. U.S. Provisional Patent Application Ser. No. 62/220,109, filed Sep. 17, 2015 and entitled "Nanocrystalline Alloy Penetrators," is also incorporated herein by reference in its entirety for all purposes.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present invention.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in some embodiments, to A without B (optionally including elements other than B); in another embodiment, to B without A (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in some embodiments, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Any terms as used herein related to shape, orientation, alignment, and/or geometric relationship of or between, for example, one or more articles, structures, forces, fields, flows, directions/trajectories, and/or subcomponents thereof and/or combinations thereof and/or any other tangible or intangible elements not listed above amenable to characterization by such terms, unless otherwise defined or indicated, shall be understood to not require absolute conformance to a mathematical definition of such term, but, rather, shall be understood to indicate conformance to the mathematical definition of such term to the extent possible for the subject matter so characterized as would be understood by one skilled in the art most closely related to such subject matter. Examples of such terms related to shape, orientation, and/or geometric relationship include, but are not limited to terms descriptive of: shape—such as, round, square, circular/circle, rectangular/rectangle, triangular/triangle, cylindrical/cylinder, elliptical/ellipse, (n)polygonal/(n)polygon, etc.; angular orientation—such as perpendicular, orthogonal, parallel, vertical, horizontal, collinear, etc.; contour and/or trajectory—such as, plane/planar, coplanar, hemispherical, semi-hemispherical, line/linear, hyperbolic, parabolic, flat, curved, straight, arcuate, sinusoidal, tangent/tangential, etc.; direction—such as, north, south, east, west, etc.; surface and/or bulk material properties and/or spatial/temporal resolution and/or distribution—such as, smooth, reflective, transparent, clear, opaque, rigid, impermeable, uniform(ly), inert, non-wettable, insoluble, steady, invariant, constant, homogeneous, etc.; as well as many others that would be apparent to those skilled in the relevant arts. As one example, a fabricated article that would described herein as being "square" would not require such article to have faces or sides that are perfectly planar or linear and that intersect at angles of exactly 90 degrees (indeed, such an article can only exist as a mathematical abstraction), but rather, the shape of such article should be interpreted as approximating a "square," as defined mathematically, to an extent typically achievable and achieved for the recited fabrication technique as would be understood by those skilled in the art or as specifically described. As another example, two or more fabricated articles that would described herein as being "aligned" would not require such articles to have faces or sides that are perfectly aligned (indeed, such an article can only exist as a mathematical abstraction), but rather, the arrangement of such articles should be interpreted as approximating "aligned," as defined mathematically, to an extent typically achievable and achieved for the recited fabrication technique as would be understood by those skilled in the art or as specifically described.

What is claimed is:

1. A munition, comprising:

a propellant contained within a cavity of the munition; and a penetrator;

wherein the penetrator comprises a nanocrystalline alloy comprising at least one of:

metallic W and at least one of metallic V, metallic Sc, and metallic Cr; and metallic Cr and at least one of metallic Pd and metallic Ni; and the nanocrystalline alloy has a cross-sectional average grain size of less than or equal to about 100 nm.

2. The munition of claim 1, wherein the nanocrystalline alloy does not contain iron or contains iron in an amount of less than 3.8 at%.

3. The munition of claim 1, wherein the nanocrystalline alloy has grains with an aspect ratio of less than about 2.

4. The munition of claim 1, wherein the penetrator is at least partially contained within a housing.

5. The munition of claim 1, wherein the nanocrystalline alloy further comprises Ti.

6. A munition, comprising:

a propellant contained within a cavity of the munition; and a penetrator comprising a nanocrystalline alloy comprising at least one of:

metallic W and at least one of metallic V, metallic Sc, and metallic Cr; and metallic Cr and at least one of metallic Pd and metallic Ni;

wherein, when the penetrator is projected at and orthogonal to a 6061-T6511 Aluminum target and strikes the target at a velocity of 1 km/s, the penetrator has a first width prior to striking the target, and a second width after striking the target and coming to rest, the second width being less than about 105% of the first width.

7. The munition of claim 6, wherein the second width is less than about 102% of the first width.

8. The munition of claim 6, wherein the second width is less than about 101% of the first width.

9. A munition, comprising:

a propellant contained within a cavity of the munition; and a penetrator comprising a nanocrystalline alloy comprising at least one of:

metallic W and at least one of metallic V, metallic Sc, and metallic Cr; and metallic Cr and at least one of metallic Pd and metallic Ni;

wherein, when the penetrator is projected at and orthogonal to a 6061-T6511 Aluminum target and strikes the target at a velocity of 1 km/s, the penetrator has a first length prior to striking the target, and a second length after striking the target and coming to rest, the second length being within about 5% of the first length.

10. The munition of claim 9, wherein the second length is within about 2% of the first length.

11. The munition of claim 9, wherein the second length is within about 1% of the first length.

12. The munition of claim 6, wherein the nanocrystalline alloy has a cross-sectional average grain size of less than or equal to about 100 nm.

13. The munition of claim 6, wherein the nanocrystalline alloy comprises 0 at% to about 3.8 at% Fe.

14. The munition of claim 13, wherein the nanocrystalline alloy comprises less than or equal to about 2 at% Fe.

15. The munition of claim 13, wherein the nanocrystalline alloy comprises between about 0.1 at% and about 3.8 at% Fe.

16. The munition of claim 9, wherein the nanocrystalline alloy comprises both W and Cr in a solid solution.

17. The munition of claim 9, wherein the nanocrystalline alloy further comprises Ti.

18. The munition of claim 9, wherein the nanocrystalline alloy has a relative density of at least about 75%.

19. The munition of claim 9, wherein the nanocrystalline alloy has a cross-sectional average grain size of less than or equal to about 100 nm.

20. The munition of claim 1, wherein the nanocrystalline alloy comprises metallic W.

21. The munition of claim 20, wherein the metallic W is present in an amount of at least 40 at%.

22. The munition of claim 20, wherein the nanocrystalline alloy comprises metallic Cr in solid solution with the metallic W.

23. The munition of claim 1, wherein the penetrator comprises a nanocrystalline alloy comprising metallic W and at least one of metallic V, metallic Sc, and metallic Cr.

24. The munition of claim 23, wherein the penetrator comprises a nanocrystalline alloy comprising metallic W and metallic Cr.

25. The munition of claim 1, wherein the penetrator comprises a nanocrystalline alloy comprising metallic Cr and at least one of metallic Pd and metallic Ni.

26. The munition of claim 6, wherein the penetrator comprises a nanocrystalline alloy comprising metallic W and at least one of metallic V, metallic Sc, and metallic Cr.

27. The munition of claim 26, wherein the penetrator comprises a nanocrystalline alloy comprising metallic W and metallic Cr.

28. The munition of claim 6, wherein the penetrator comprises a nanocrystalline alloy comprising metallic Cr and at least one of metallic Pd and metallic Ni.

29. The munition of claim 9, wherein the penetrator comprises a nanocrystalline alloy comprising metallic W and at least one of metallic V, metallic Sc, and metallic Cr.

30. The munition of claim 29, wherein the penetrator comprises a nanocrystalline alloy comprising metallic W and metallic Cr.

31. The munition of claim 9, wherein the penetrator comprises a nanocrystalline alloy comprising metallic Cr and at least one of metallic Pd and metallic Ni.

* * * * *